US010921754B2

(12) United States Patent
Zanesco et al.

(10) Patent No.: US 10,921,754 B2
(45) Date of Patent: Feb. 16, 2021

(54) DEVICE FOR CONTROLLING AT LEAST TWO ELECTRONIC AND/OR MECHANICAL FUNCTIONS OF A PORTABLE OBJECT

(71) Applicant: ETA SA Manufacture Horlogere Suisse, Grenchen (CH)

(72) Inventors: Vittorio Zanesco, Neuchatel (CH); Pascal Lagorgette, Bienne (CH); Pascal Meyer, Neuchatel (CH); Damien Schmutz, Salavaux (CH); Raphael Balmer, Vicques (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 403 days.

(21) Appl. No.: 15/800,819

(22) Filed: Nov. 1, 2017

(65) Prior Publication Data

US 2018/0157219 A1 Jun. 7, 2018

(30) Foreign Application Priority Data

Dec. 6, 2016 (EP) ..... 16202471

(51) Int. Cl.
*G04G 21/00* (2010.01)
*G04B 27/00* (2006.01)
(Continued)

(52) U.S. Cl.
CPC ..... *G04G 21/00* (2013.01); *G04B 19/25* (2013.01); *G04B 27/002* (2013.01); *G04C 3/001* (2013.01); *G04C 3/005* (2013.01)

(58) Field of Classification Search
CPC ..... G04C 3/00; G04C 3/001; G04C 3/002; G04C 3/005; G04G 5/00; G04G 21/00;
(Continued)

(56) References Cited

U.S. PATENT DOCUMENTS 1,337,217 A * 4/1920 Gillingham ..... H01H 13/00 200/51 R
2,668,200 A * 2/1954 Glaze ..... H01H 25/06 200/1 A
(Continued)

FOREIGN PATENT DOCUMENTS

CH 646 572 A3 12/1984
JP 55-119324 9/1980

OTHER PUBLICATIONS

European Search Report dated May 9, 2017 in European Application 16202471.5, filed on Dec. 6, 2016 (with English Translation of Categories of cited documents).
(Continued)

*Primary Examiner* — Sean Kayes
(74) *Attorney, Agent, or Firm* — Oblon, McClelland, Maier & Neustadt, L.L.P.

(57) ABSTRACT

A device for controlling at least two electronic and/or mechanical functions of a portable object of small dimensions includes a control stem that is axially movable between at least a first and a second position. The control stem is provided at a first end with an actuation member, and is provided towards a second end with a position indexing plate arranged to cooperate with an elastic member in order to match each of the first and second positions of the control stem with one of the mechanical or electronic functions.

22 Claims, 13 Drawing Sheets g. 7B

(51) Int. Cl.
*G04B 19/25* (2006.01)
*G04C 3/00* (2006.01)

(58) Field of Classification Search
CPC ..... G04G 27/002; H01H 25/06; H01H 13/00; H01H 2011/0025; H01H 19/14; H01H 3/12; G04B 19/25
USPC ..... 200/11 A, 11 B, 11 G, 16 R, 16 C, 50.36
See application file for complete search history.

(56) References Cited

U.S. PATENT DOCUMENTS 2,948,832 A * 8/1960 Hollins ..... H01C 10/28 315/82
3,151,441 A * 10/1964 Akira ..... G04B 27/001 368/185
3,167,626 A * 1/1965 Caudron ..... H01H 50/541 335/192
3,244,822 A * 4/1966 Elliott ..... H01C 10/363 200/16 C
3,764,762 A * 10/1973 Roeser ..... H01H 11/0012 200/521
4,034,553 A * 7/1977 Wuthrich ..... G04B 3/043 368/320
4,319,351 A 3/1982 Fujimori et al.
4,329,080 A * 5/1982 Elley ..... E01C 23/026 404/48
4,355,921 A * 10/1982 Rousseau ..... H01H 3/12 403/316
4,367,380 A * 1/1983 Larson ..... H01H 13/705 200/5 R
4,524,251 A * 6/1985 Schulz ..... H01H 27/002 200/302.2
4,950,845 A * 8/1990 Kuroyanagi ..... H01H 9/26 200/5 B
5,436,095 A * 7/1995 Mizuno ..... G03F 1/26 430/5
5,565,662 A * 10/1996 Meyrat ..... G04C 3/005 200/4
5,907,138 A * 5/1999 Metzler ..... H01H 13/64 200/1 B
6,060,672 A * 5/2000 Sugihara ..... G07F 17/3209 200/345
7,111,979 B2 * 9/2006 Kaelin ..... G04C 3/005 368/308
7,265,305 B2 * 9/2007 Chiu ..... H01H 3/12 200/331
8,207,466 B2 * 6/2012 Singh ..... H01H 13/023 200/329
9,911,551 B2 * 3/2018 Bushnell ..... H01H 13/00
10,533,908 B1 * 1/2020 Freiberger ..... G01L 1/04
2007/0074961 A1 * 4/2007 Chiu ..... H01H 3/12 200/18
2016/0233036 A1 * 8/2016 Minami ..... H01H 3/12
2017/0093085 A1 * 3/2017 Bushnell ..... G06F 1/1656

OTHER PUBLICATIONS

Notice of the Reasons for Refusal dated Oct. 16, 2018, in Japanese Patent Application No. 2017-224478, with English translation (4 pages).
Decision of Final Rejection dated Apr. 23, 2019, in Japanese Patent Application No. 2017-224478 (5 pages).
First Office Action dated Aug. 23, 2019, Chinese Patent Application No. 201711266360.6, with English Translation. 11 pages.
Notice of Grounds for Rejection dated Feb. 27, 2019, in Korean Patent Application No. 10-2017-0166124, with English translation. (11 pages).
Notice of Final rejection dated Sep. 27, 2019, in Korean Patent Application No. 10-2017-0166124, with English translation. (6 pages).
Second Office Action issued by the Chinese Patent Office dated Aug. 5, 2020, application No. 201711266360.6,with English translation (11 pages).

* cited by examiner

Fig. 2
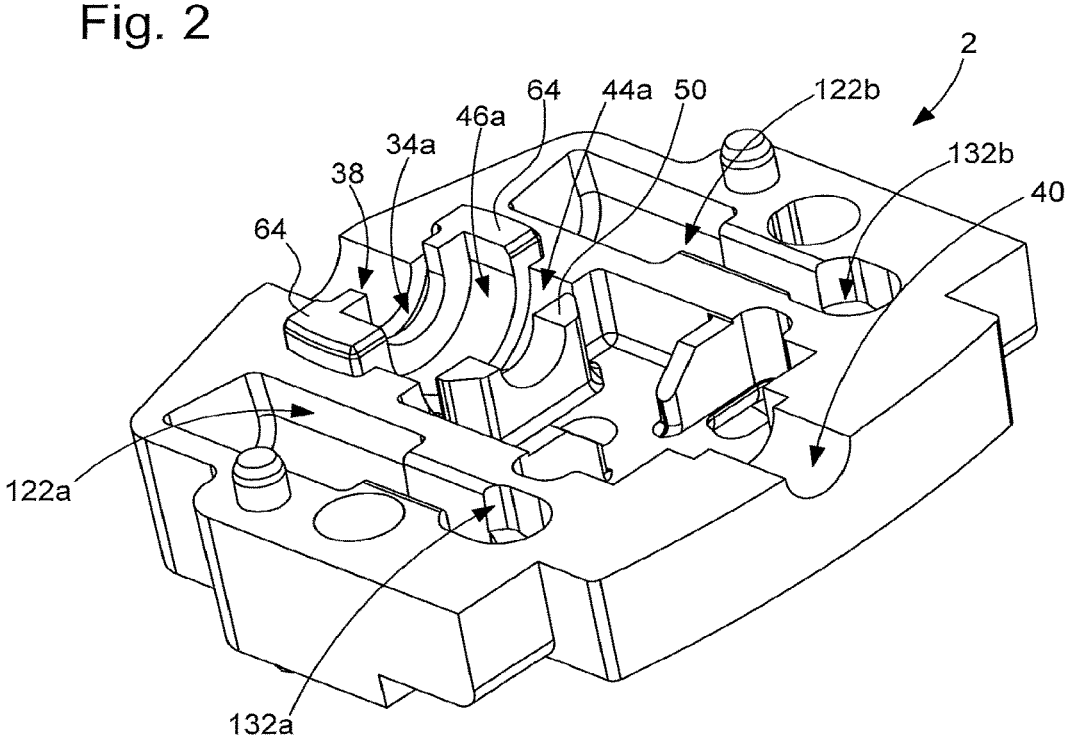
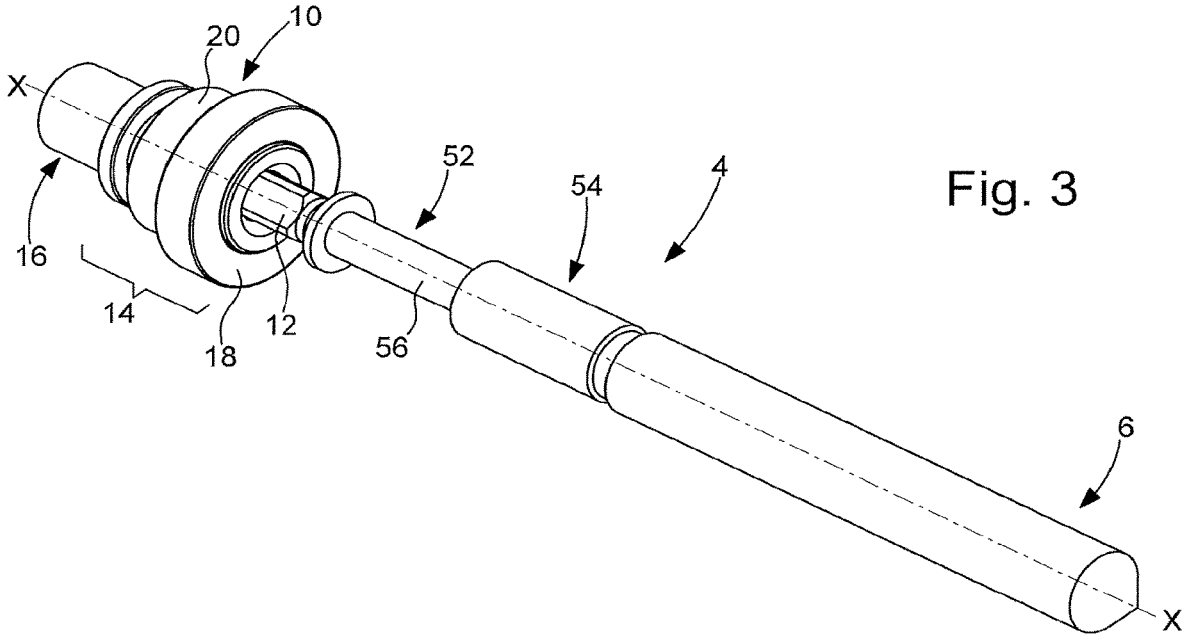
Fig. 3

DEVICE FOR CONTROLLING AT LEAST TWO ELECTRONIC AND/OR MECHANICAL FUNCTIONS OF A PORTABLE OBJECT

This application claims priority from European Patent Application No. 16202471.5 filed on Dec. 6, 2016, the entire disclosure of which is hereby incorporated herein by reference.

FIELD OF THE INVENTION

The present invention concerns a device for controlling at least two electronic and/or mechanical functions for a portable object of small dimensions. More precisely, the invention concerns such a device comprising a control stem provided with a mechanical position indexing device which makes it possible to match each electronic or mechanical function with a distinct position of the control stem.

BACKGROUND OF THE INVENTION

The present invention concerns the field of control stems which are fitted to portable objects of small dimensions, such as timepieces, and which are arranged to control one or more electronic and/or mechanical functions of such objects.

In a very simplified manner, control stems of this type comprise a cylindrical portion whose length is substantially greater than its diameter, and at one end of which, located outside the portable object, is fixed a crown enabling a user to actuate the control stem and to adjust the electronic or mechanical function or functions. In the case where these stems control several functions, each given function must be able to be matched with a determined position of the control stem.

An example of such a control stem is illustrated in FIG. 22, annexed to this patent application. Designated as a whole by the general reference numeral 200, this control stem includes a cylindrical portion 202 which finishes with an actuation crown 204 at its end located outside the portable object (not represented) which is fitted with an actuation crown 204. Towards its end opposite actuation crown 204, cylindrical portion 202 of control stem 200 is provided with a cam path 206 formed of three successive annular grooves 208*a*, 208*b* and 208*c* separated from each other by two flanges 210*a* and 210*b* of substantially rounded profiles. The dimensions of annular grooves 208*a*-208*c* are adapted to those of the elastic arms 212 of a spring 214, for example, a U-shaped spring, which projects, for example, into annular groove 208*a* of path cam 206. It is understood that, in order to make elastic arms 212 of spring 214 move from annular groove 208*a* into annular groove 208*b*, the user must exert on control stem 200 a traction force greater than the force necessary for elastic arms 212 to move apart and slide over flange 210*a* before closing again on annular groove 208*b*. Conversely, if it is desired to move elastic arms 212 of spring 214 from annular groove 208*b* into annular groove 208*a*, a thrust force must be exerted on control stem 200 sufficient to enable elastic arms 212 to deform and cross flange 210*a* and drop into annular groove 208*a*. The same applies to the transition of elastic arms 212 of spring 214 from annular groove 208*b* into annular groove 208*c* and vice versa.

Thus, through cooperation between the elastic arms of a spring and a cam path which is integral with the cylindrical portion of a control stem, it is advantageously possible to define, for example, three stable positions of the control stem which each correspond to the adjustment of a given function. The drawback of this solution lies, however, in the fact that, in order to machine the cam path in the cylindrical portion of the control stem, the diameter of the cylindrical portion of the control stem must be relatively large, which makes the use of such a control stem quite difficult, or even impossible, especially in the field of wristwatches where it is not desired to machine large diameter holes in the case middle, in particular due to the thickness of the case middle.

SUMMARY OF THE INVENTION

It is an object of the present invention to overcome the aforementioned problems, in addition to others, by providing a device for controlling at least two electronic and/or mechanical functions, comprising a stem whose diameter is sufficiently small for it to be usable notably in the field of horology.

To this end, the present invention concerns a device for controlling at least two electronic and/or mechanical functions of a portable object of small dimensions, this device comprising a control stem axially movable between at least a first and a second position, this control stem being provided, at a first end, with an actuation member, and being provided, towards a second end, with a position indexing plate arranged to cooperate with an elastic member in order to match each of the first and second positions of the control stem with one of the mechanical or electronic functions.

According to other features of the invention which form the subject of the dependent claims:

- the indexing plate extends substantially in a horizontal plane;
- the elastic member includes two elastic arms which cooperate with two identical cam paths provided in the position indexing plate to define the first and second position of the control stem;
- the two cam paths define one unstable position and one stable position of the control stem, or the two cam paths define a first and a second stable position of the control stem;
- in the case where the two cam paths define a first stable position and a second stable position of the control stem, the cam paths include a first recess separated from a second recess by a peak, the first and second recesses defining the first and second stable positions of the control stem, the elastic arms of the elastic member passing from the first recess to the second recess and vice versa by crossing the peak;
- in the case where the two cam paths define one stable position and one unstable position of the control stem, the cam paths include a recess which defines the stable position and which the elastic arms of the elastic member leave to engage on a ramp profile which moves the elastic arms away from their rest position and which defines the unstable position of the control stem;
- the position indexing plate is housed inside a groove provided in the control stem;
- the position indexing plate is integral with the control stem, or the position indexing plate is removably coupled to the control stem;
- in the case where the position indexing plate is removably coupled to the control stem, the coupling between the position indexing plate and the control stem is an elastic coupling arranged to prevent the uncoupling of the position indexing plate and the control stem in normal conditions of use.

As a result of these features, the present invention provides a device for controlling at least two electronic or mechanical functions whose dimensions are restricted, which makes it possible to install such a control device inside a portable object of small dimensions, such as in particular a wristwatch. In fact, the mechanical structure for indexing the position of the control stem is shifted from the actual control stem to a position indexing plate which is machined separately from the control stem. This plate is relatively thin and also extends in a substantially horizontal plane, whereas, when the mechanical, position indexing structure is arranged on the control stem, it necessarily increases the diameter of the control stem and therefore the height of the case middle of the portable object, so that the portable object is thicker, which is sought to be avoided, particularly in the field of timepieces.

Further, in the control device according to the invention, friction is virtually eliminated to limit wear to the maximum extent possible and ensure the greatest possible longevity of the control device. Further, the less friction there is, the easier it is to operate the control stem, in particular in the unstable pushed-in position. In order to minimize this friction, it is particularly important to note that none of the electrical contacts produced in the control device according to the invention are achieved by friction. The electrical contacts are all achieved by the abutment of one part against another. There is therefore much less wear than in the case of parts which rub against each other. The same is true of the position indexing plate, whose upward travel is limited by the limiting spring with which the position indexing plate, and therefore the control stem, is not, however, in contact in normal operating conditions. Here too, no friction is observed.

Finally, the fact that the control stem and the indexing plate are not inseparably mounted ensures the disassemblability of the control device, which is advantageous particularly in the case where the timepiece equipped with the control device according to the invention has a certain price.

It will also be noted that the electrical contacts produced in the control device according to the invention are all of the galvanic type, which means that in the absence of electrical contact, the control device has zero electricity consumption.

BRIEF DESCRIPTION OF THE DRAWINGS

Other features and advantages of the present invention will appear more clearly from the following detailed description of an example embodiment of a control device according to the invention, this example being given solely by way of non-limiting illustration with reference to the annexed drawing, in which:

FIG. 2 is a top, perspective view of the lower frame.

FIG. 3 is a perspective view of the control stem which, from left to right, extends from its rear end to its front end.

DETAILED DESCRIPTION OF ONE EMBODIMENT OF THE INVENTION

The present invention proceeds from the general inventive idea which consists in transferring a position indexing mechanism for a stem controlling at least two electronic and/or mechanical functions of a portable object of small dimensions, such as a timepiece, from this control stem to a plate machined separately from said control stem. By doing so, it is possible to reduce the diameter of the control stem and thus concomitantly to reduce the thickness of the case middle of the portable object, such as a timepiece. This result is achieved as a result of the fact that, instead of being structured straight onto the control stem, the indexing mechanism, which typically takes the form of two cam paths cooperating with an elastic member, is made in a thin plate which forms a separate part from the control stem and which is mechanically coupled to the latter. As the control stem is without its indexing mechanism, its diameter can be reduced, and the small thickness of the position indexing plate of the invention does not result in any significant increase in the dimensions of the control stem of the invention.

In all that follows, the back-to-front direction is a rectilinear direction which extends horizontally along longitudinal axis of symmetry X-X of the control stem from the external actuation crown towards the interior of the portable object equipped with the control device, parallel to a plane in which a back of the portable object extends. Thus, the control stem will be pushed from back to front, and will be pulled from front to back. Further, the vertical direction is a direction that extends perpendicularly to the plane in which the control stem extends.

Figure 1:
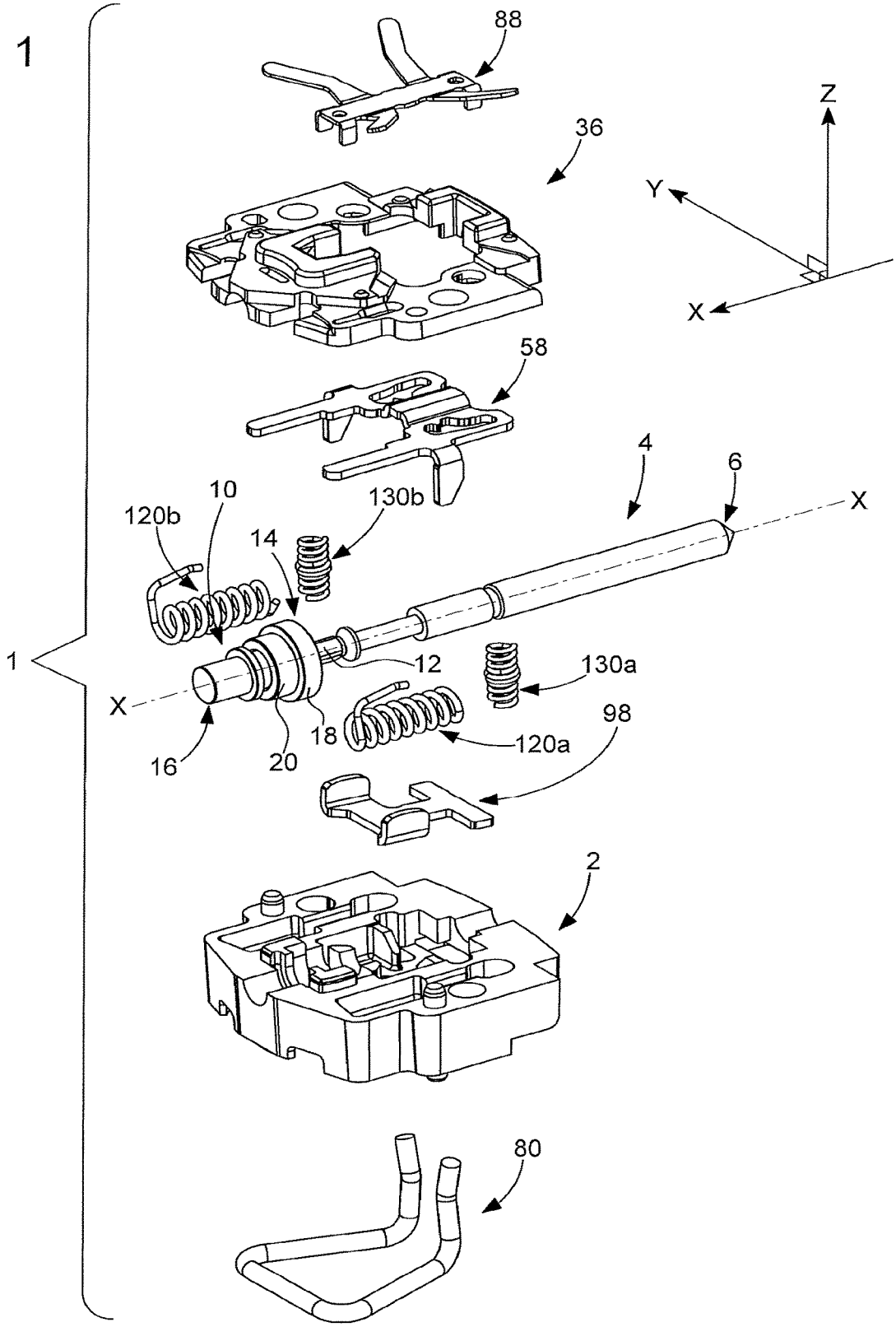
FIG. 1 is a perspective view, in an unassembled state, of a device for controlling at least one electronic function of a portable object of small dimensions.

FIG. 1 is a perspective view, in an unassembled state, of a device for controlling at least one electronic function of a portable object of small dimensions, such as a wristwatch. Designated as a whole by the general reference number 1, this control device includes (see FIG. 2) a lower frame 2, made for example of an injected plastic material or of a non-magnetic metallic material such as brass. This lower frame 2 serves as a cradle for a control stem 4 preferably of elongated and substantially cylindrical shape, provided with a longitudinal axis of symmetry X-X (see FIG. 3). This control stem 4 is arranged to slide from front to back and from back to front along its longitudinal axis of symmetry X-X and/or to rotate about said same axis of longitudinal symmetry X-X in the clockwise and anticlockwise direction.

Figure 18:
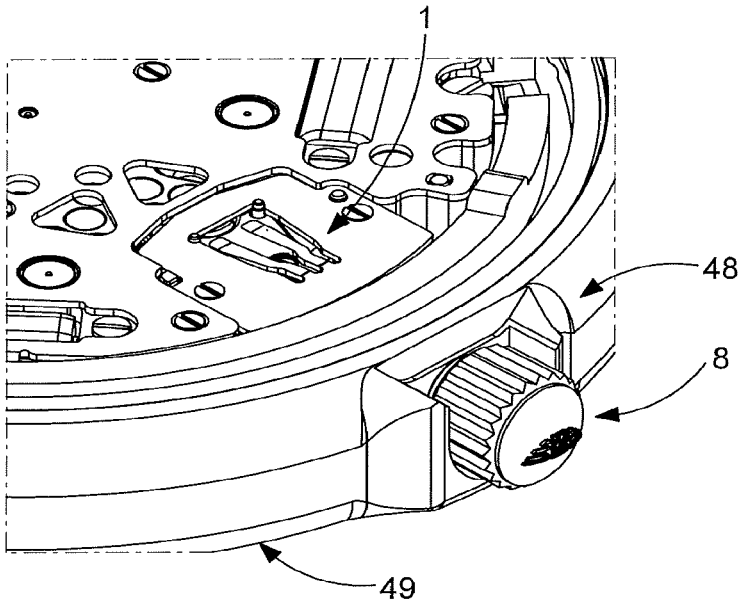
FIG. 18 is a perspective view of the control device installed in a portable object.

At a rear end 6, which will be located outside the portable object once the latter is equipped with a control device 1, control stem 4 will receive an actuation crown 8 (see FIG. 18).

At a front end 10, which will be located inside control device 1 once the latter is assembled, control stem 4 has, for example, a square section 12 and receives in succession a magnetic assembly 14 and a smooth bearing 16.

Figure 4:
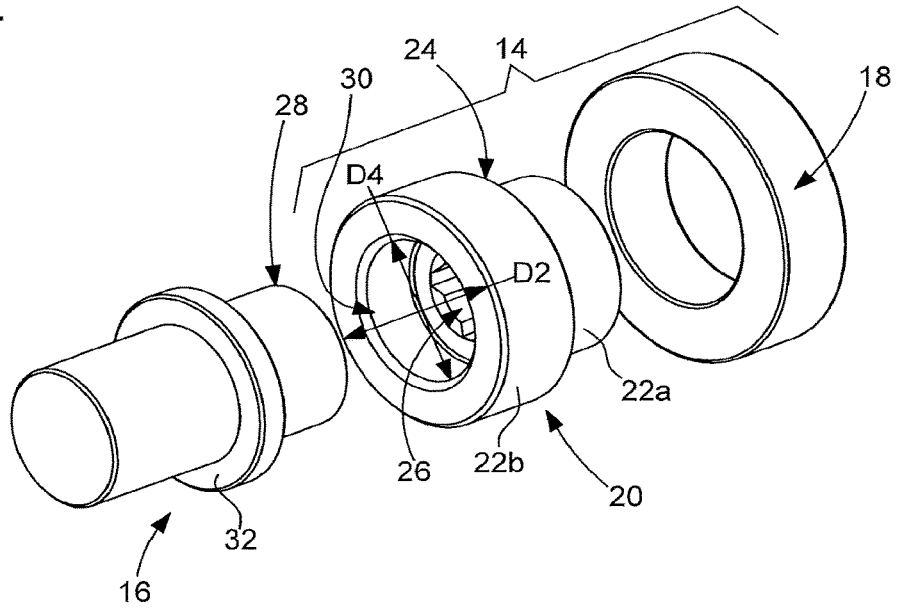
FIG. 4 is a perspective view, in an unassembled state, of the magnetic assembly formed of a support ring and a magnetized ring and the smooth bearing.
Figure 5:
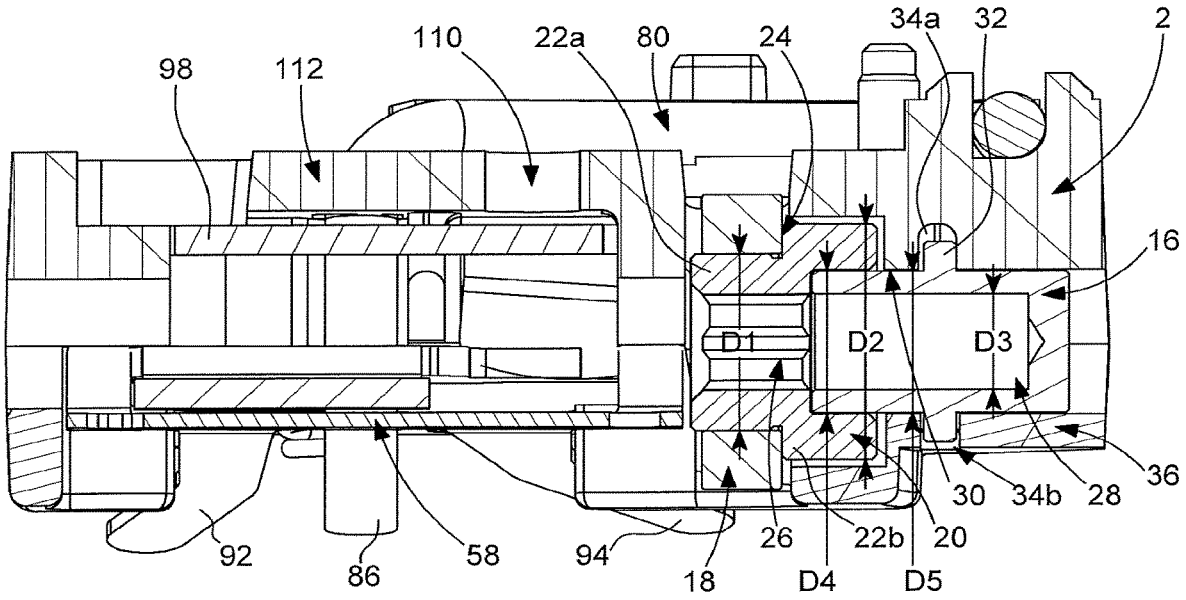
FIG. 5 is a longitudinal cross-sectional view along a vertical plane of a control device inside which are arranged the smooth bearing and the magnetic assembly formed of the support ring and the magnetized ring.

Magnetic assembly 14 includes a bipolar or multipolar magnetized ring 18 and a support ring 20, on which magnetized ring 18 is fixed, typically by adhesive bonding (see FIG. 4). Support ring 20 is a component of generally cylindrical shape. As seen in FIG. 5, support ring 20 has, from back to front, a first section 22*a* having a first external diameter D1 on which is engaged magnetized ring 18, and a second section 22*b* having a second external diameter D2 greater than first external diameter D1 and which delimits a shoulder 24 against which magnetized ring 18 abuts. The first section 22*a* of support ring 20 is pierced with a square hole 26 which is adapted in shape and size to square section 12 of control stem 4 and forms with control stem 4 a sliding pinion type system. In other words, support ring 20 and magnetized ring 18 remain immobile when control stem 4 is made to slide axially. However, control stem 4 drives support ring 20 and magnetized ring 18 in rotation when control stem 4 is rotated. It is clear from the foregoing that magnetized ring 18, carried by support ring 20, is not in contact with control stem 4 which makes it possible to protect it in the event of shocks applied to the portable object equipped with a control device 1.

Smooth bearing 16 defines (see FIG. 5) a cylindrical housing 28 whose first internal diameter D3 is very slightly greater than the diameter of the circle in which is inscribed square section 12 of control stem 4, to allow control stem 4 to slide axially and/or to rotate inside this cylindrical housing 28. Smooth bearing 16 thus ensures perfect axial guiding of control stem 4.

It is noted that the square hole 26 provided in first section 22*a* of support ring 20 is extended towards the front of control device 1 by an annular hole 30 whose second internal diameter D4 is fitted onto third external diameter D5 of smooth bearing 16. Support ring 20 is thus fitted for free rotation on smooth bearing 16 and moves into axial abutment against smooth bearing 16, which ensures the perfect axial alignment of these two components and makes it possible to correct any problems of concentricity that may be caused by a sliding pinion type coupling.

Figure 6:
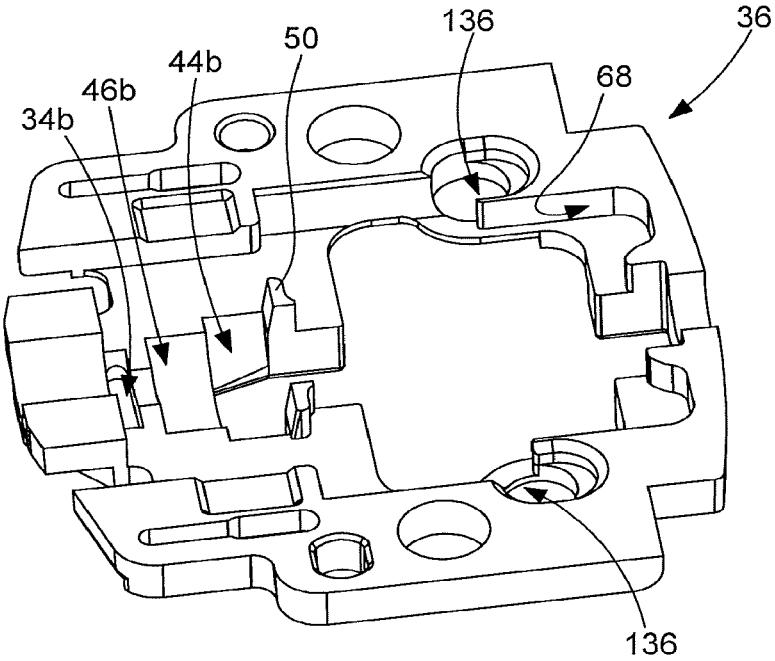
FIG. 6 is a bottom, perspective view of the upper frame.

It is observed that, for axial immobilization thereof, smooth bearing 16 is provided on its outer surface with a circular collar 32 which projects into a first groove 34*a* and into a second groove 34*b*, respectively arranged in lower frame 2 (see FIG. 2) and in an upper frame 36 (see FIG. 6), arranged to cover lower frame 2 and, for example, made of an injected plastic material or of a non-magnetic metallic material, such as brass. These two lower and upper frames 2 and 36 will be described in detail below.

It is important to note that the magnetic assembly 14 and smooth bearing 16 described above are indicated purely for illustrative purposes. Indeed, smooth bearing 16, for example made of steel or brass, is arranged to prevent control stem 4, for example made of steel, rubbing against lower and upper frames 2 and 36, and causing wear of the plastic material of which these two lower and upper frames 2 and 36 are typically made. However, in a simplified embodiment, it is possible to envisage not using such a smooth bearing 16 and arranging for control stem 4 to be directly carried by lower frame 2.

Likewise, magnetized ring 18, and support ring 20 on which magnetized ring 18 is fixed, are intended for the case where rotation of control stem 4 is detected by a local variation in the magnetic field induced by the pivoting of magnetized ring 18. It is, however, entirely possible to envisage replacing magnetic assembly 14, for example with a sliding pinion which, according to its position, will for example control the winding of a mainspring or the time-setting of a watch equipped with control device 1.

It is also important to note that the example of control stem 4 provided on one part of its length with a square section is given purely for illustrative purposes. Indeed, in order to drive magnetic assembly 14 in rotation, control stem 4 may have any type of section other than a circular section, for example triangular or oval.

Lower frame 2 and upper frame 36, the combined assembly of which defines the external geometry of control device 1, are for example, of generally parallelepiped shape. Lower frame 2 forms a cradle which receives control stem 4 (see FIG. 2). To this end, lower frame 2 includes, towards the front, a first receiving surface 38 of semicircular profile, which serves as a seat for smooth bearing 16 and in which is provided the first groove 34*a* which receives circular collar 32. Both axial and rotational immobilization of smooth bearing 1 are thus ensured.

Figure 19:
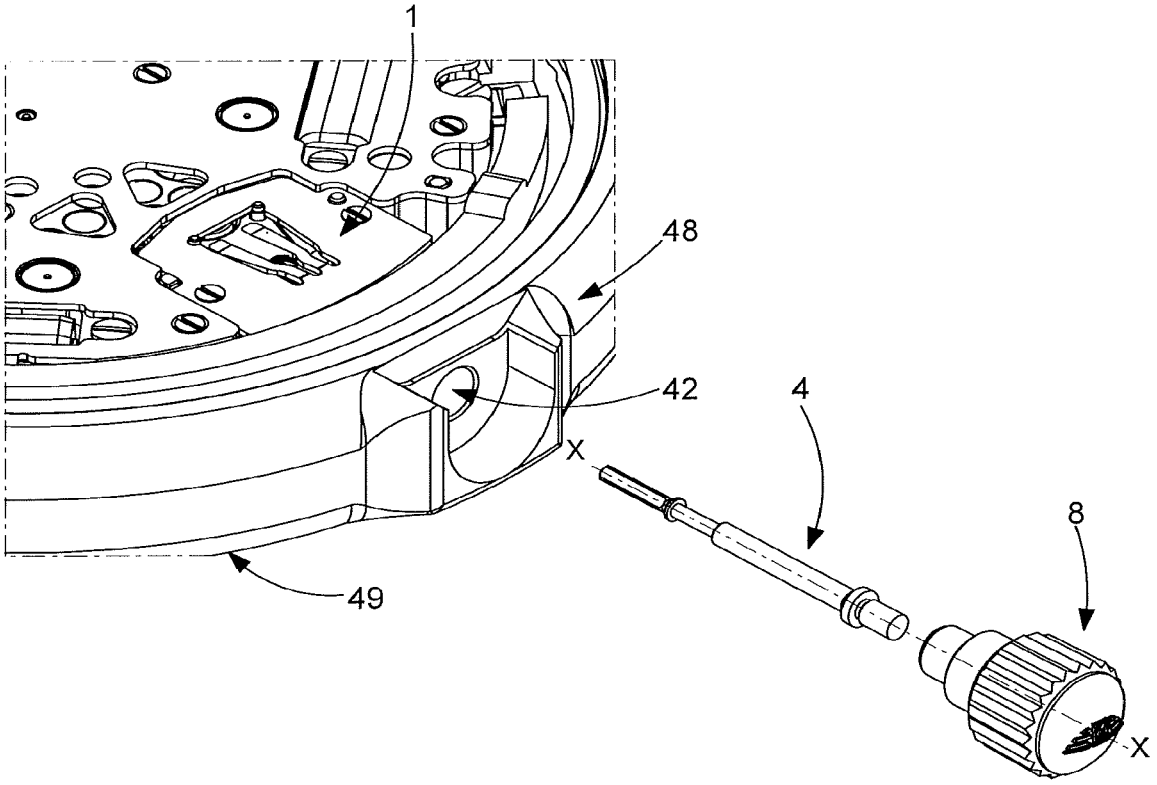
FIG. 19 is a similar view to that of FIG. 18, with the control stem removed from the portable object.

Lower frame 2 further includes, towards the back, a second receiving surface 40, whose semicircular profile is centred on longitudinal axis of symmetry X-X of control stem 4, but whose diameter is greater than that of control stem 4. It is important to understand that control stem 4 only rests on second receiving surface 40 at the stage when the assembled control device 1 is tested prior to being integrated in the portable object. At this assembly stage, control stem 4 is inserted into control device 1 for test purposes and extends horizontally, supported and axially guided by smooth bearing 16 at its front end 10 and via second receiving surface 40 at its rear end 6. However, once control device 1 is integrated in the portable object, control stem 4 passes through a hole 42 provided in case middle 48 of the portable object in which it is guided and supported (see FIG. 19) and which is delimited downwardly by a bottom case 49.

Third and fourth clearance surfaces 44*a* and 46*a* of semicircular profile are also provided in lower frame 2 and complementary clearance surfaces 44*b* and 46*b* (see FIG. 6) are provided in upper frame 36 for receiving magnetic assembly 14, formed of magnetized ring 18 and of its support ring 20. It will be noted that magnetized ring 18 and its support ring 20 are not in contact with third and fourth clearance surfaces 44*a* and 46*a* and complementary clearance surfaces 44*b* and 46*b* when control device 1 is assembled and mounted in the portable object. It is also noted that third clearance surface 44*a* and its corresponding complementary clearance surface 44*b* are delimited by a circular collar 50 for axially locking magnetic assembly 14.

As visible in FIG. 3, behind square section 12, control stem 4 has a cylindrical section 52 whose diameter is comprised between the diameter of the circle in which is inscribed square section 12 of control stem 4 and the primitive diameter of a rear section 54 of said control stem 4, at the end of which is fixed actuation crown 8. This cylindrical section 52 of reduced diameter forms a groove 56 inside which is placed a position indexing plate 58 for control stem 4 (see FIGS. 7A and 7B). To this end, position indexing plate 58 has a curved portion 60 which follows the profile of reduced diameter cylindrical section 52 and which allows position indexing plate 58 to extend substantially horizontally. Position indexing plate 58 may be, for example, obtained by stamping a thin, electrically conductive metal sheet. However, it is also possible to envisage making position indexing plate 58, for example, by moulding a hard plastic material loaded with conductive particles. The engagement of position indexing plate 58 in groove 56 ensures the coupling in translation, from front to back and from back to front, between control stem 4 and position indexing plate 58. However, as will become clearer below, position indexing plate 58 is free with respect to control stem 4 in a vertical direction z perpendicular to the longitudinal axis of symmetry X-X of control stem 4.

Figure 7A:
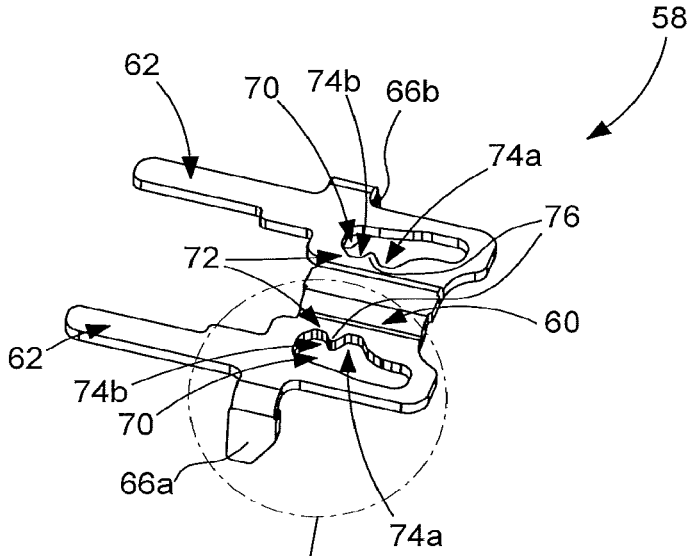
FIG. 7A is a top, perspective view of the plate for indexing the position of the control stem.
Figure 7B:
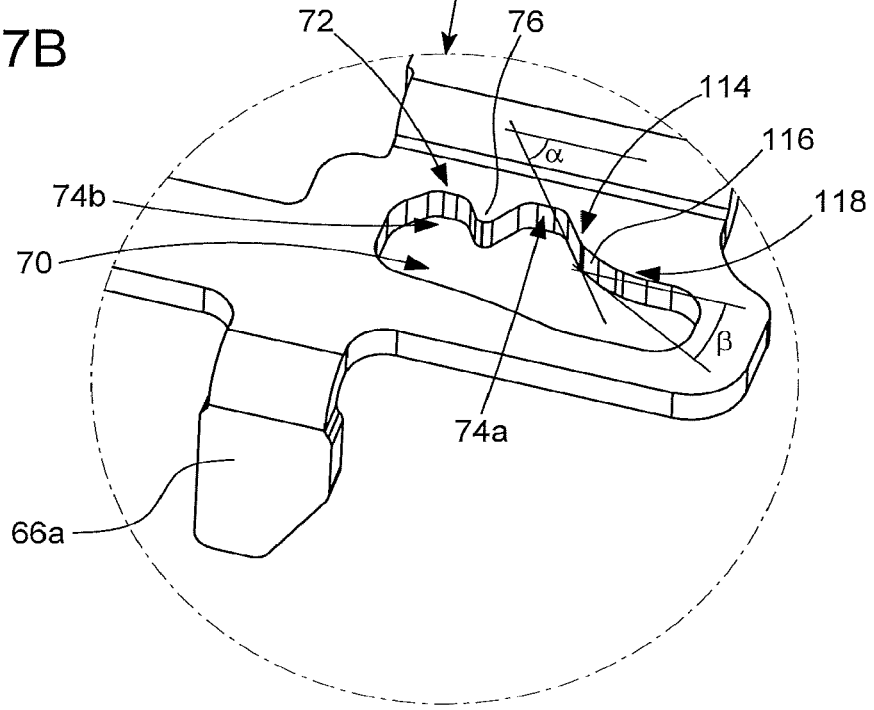
FIG. 7B is a larger scale view of the area encircled in FIG. 7A.

As visible in FIG. 7A, position indexing plate 58 is a substantially flat and generally U-shaped part. This position indexing plate 58 includes two substantially rectilinear guide arms 62 which extend parallel to each other and which are connected to each other by curved portion 60. These two guide arms 62 are axially guided, for example, against two studs 64 arranged in lower frame 2. Guided by its two guide arms 62, position indexing plate 58 slides along a rim 68 arranged in upper frame 36 and whose perimeter corresponds to that of position indexing plate 58 (see FIG. 6). Position indexing plate 58 also includes two fingers 66*a*, 66*b* which extend vertically downwards on either side of the two guide arms 62.

In sliding along rim 68, position indexing plate 58 has the function of ensuring the translational guiding of control stem 4 from front to back and from back to front. Fingers 66*a*, 66*b*, are intended, in particular, to prevent position indexing plate 58 from bracing when the latter moves in translation.

Two apertures 70 exhibiting an approximately rectangular contour are provided in guide arms 62 of position indexing plate 58. These two apertures 70 extend symmetrically on either side of longitudinal axis of symmetry X-X of control stem 4. The sides of the two apertures 70 closest to longitudinal axis of symmetry X-X of control stem 4 have a cam path 72 of substantially sinusoidal shape, formed of a first and a second recess 74*a*, 74*b* separated by a peak 76.

Figure 8:
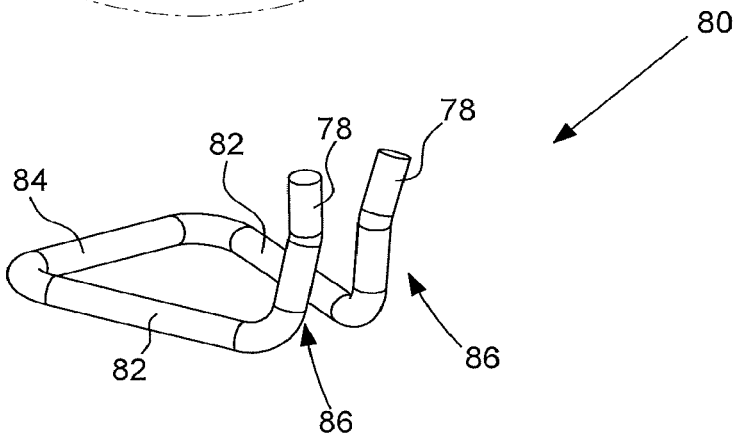
FIG. 8 is a perspective view of the positioning spring arranged to cooperate with the plate for indexing the position of the control stem.

The two apertures 70 provided in guide arms 62 are intended to receive the two ends 78 of a positioning spring 80 (see FIG. 8). This positioning spring 80 is generally U-shaped with two arbors 82 which extend in a horizontal plane and which are connected to each other by a base 84. At their free end, the two arbors 82 are extended by two substantially rectilinear arms 86 which stand upright. Positioning spring 80 is intended to be mounted in control device 1 through the bottom of lower frame 2, so that ends 78 of arms 86 project into apertures 70 of position indexing plate 58. It will be seen below that the cooperation between position indexing plate 58 and positioning spring 80 makes it possible to index the position of control stem 4 between an unstable pushed-in position T0 and two stable positions T1 and T2.

Figure 9:
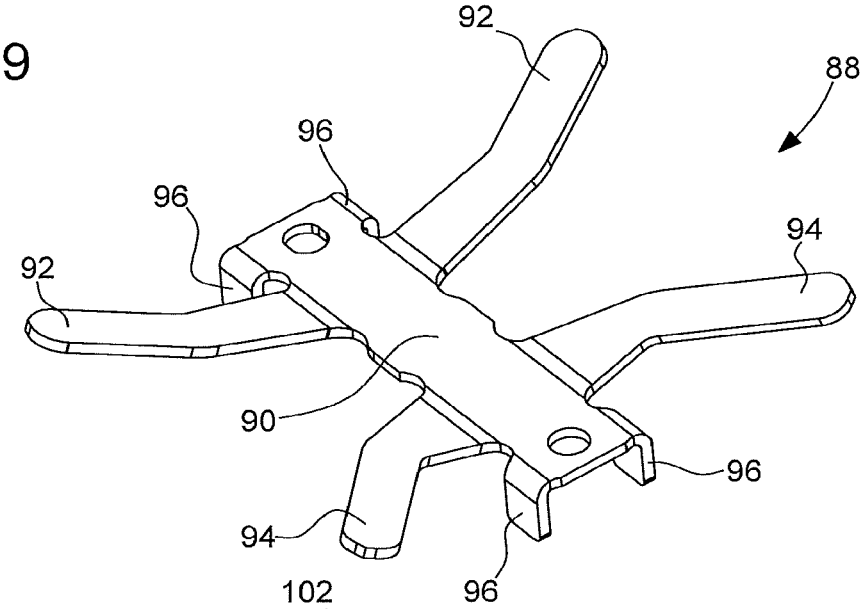
FIG. 9 is a top, perspective view of the spring for limiting the displacement of the control stem position indexing plate.

It was mentioned above that position indexing plate 58 is coupled in translation to control stem 4, but that it is free with respect to control stem 4 in the vertical direction z. It is thus necessary to take steps to prevent position indexing plate 58 disengaging from control stem 4 in normal conditions of use, for example under the effect of gravity. To this end (see FIG. 9), a spring 88 for limiting the displacement of position indexing plate 58 in vertical direction z is placed above and at a short distance from position indexing plate 58. Displacement limiting spring 88 is captive between lower frame 2 and upper frame 36 of control device 1, but is not, in normal conditions of use, in contact with position indexing plate 58, which prevents parasitic friction forces being exerted on control stem 4, which would make the latter difficult to operate and cause problems of wear. Displacement limiting spring 88 is, however, sufficiently close to position indexing plate 58 to prevent the latter being inadvertently uncoupled from control stem 4.

Displacement limiting spring 88 includes a substantially rectilinear central portion 90 from the ends of which extend two pairs of elastic arms 92 and 94. These elastic arms 92 and 94 extend on either side of central portion 90 of displacement limiting spring 88, upwardly away from the horizontal plane in which central portion 90 extends. As these elastic arms 92 and 94 are compressed when upper frame 36 is joined to lower frame 2, they impart elasticity to displacement limiting spring 88 along vertical direction z. Between the pairs of elastic arms 92 and 94 there is also provided one pair, and preferably two pairs, of stiff lugs 96 which extend perpendicularly downwards on either side of central portion 90 of displacement limiting spring 88. These stiff lugs 96 which move into abutment on lower frame 2 when upper frame 36 is placed on lower frame 2, ensure that a minimum space is provided between position indexing plate 58 and displacement limiting spring 88 in normal operating conditions of control device 1.

Displacement limiting spring 88 guarantees the disassemblability of control device 1. Indeed, in the absence of displacement limiting spring 88, position indexing plate 58 would have to be made integral with control stem 4 and, consequently, control stem 4 could no longer be dismantled. If control stem 4 cannot be dismantled, the movement of the timepiece equipped with control device 1 cannot be dismantled either, which is not conceivable, particularly in the case of an expensive timepiece. Thus, when control device 1, formed by joining lower and upper frames 2 and 36, is mounted inside the portable object and control stem 4 is inserted into control device 1 from outside the portable object, control stem 4 slightly lifts position indexing plate 58 against the elastic force of displacement limiting spring 88. If control stem 4 continues to be pushed forwards, there comes a moment when position indexing plate 58 drops into groove 56 under the effect of gravity. Control stem 4 and position indexing plate 58 are then coupled in translation.

Figure 10:
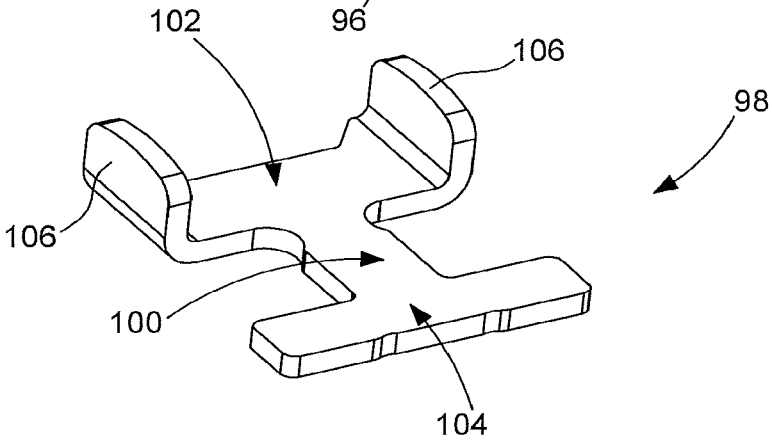
FIG. 10 is a perspective view of the disassembly? plate.
Figure 11:
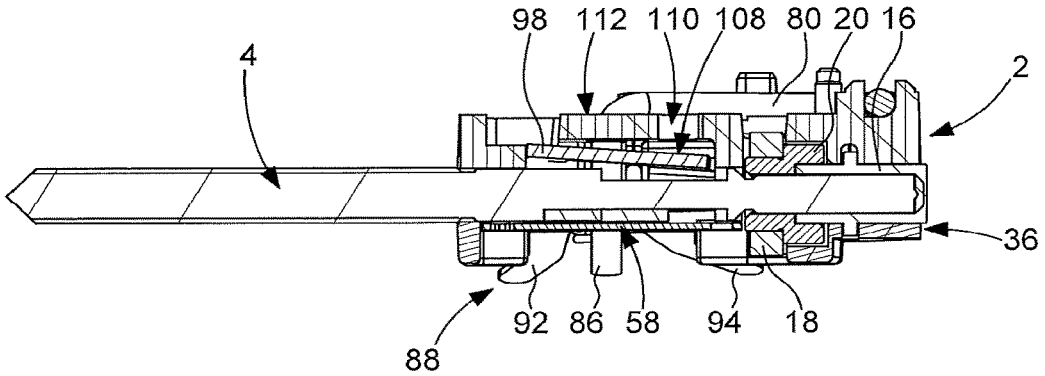
FIG. 11 is a longitudinal cross-sectional view of one part of the control device showing the hole into which a pointed tool is inserted to release the control stem from the position indexing plate.

A disassembly plate 98 is provided to allow disassembly of control stem 4 (see FIG. 10). This disassembly plate 98 is generally H-shaped and includes a straight segment 100 which extends parallel to longitudinal axis of symmetry X-X of control stem 4 and to which a first and a second cross-piece? 102 and 104 are attached. The first crosspiece 102 is also provided at its two free ends with two lugs 106 folded up substantially at right angles. Disassembly plate 98 is received inside a housing 108 provided in lower frame 2 and located underneath control stem 4. This housing 108 communicates with the outside of control device 1 via a hole 110 which opens into a lower face 112 of control device 1 (see FIG. 11). By inserting a pointed tool into hole 110, a thrust force can be exerted on disassembly plate 98 which, via its two lugs 106, in turn pushes position indexing plate 58 against the elastic force of displacement limiting spring 88. It is then sufficient to exert a slight traction on control stem 4 in order to extract the latter from control device 1.

Figure 12A:
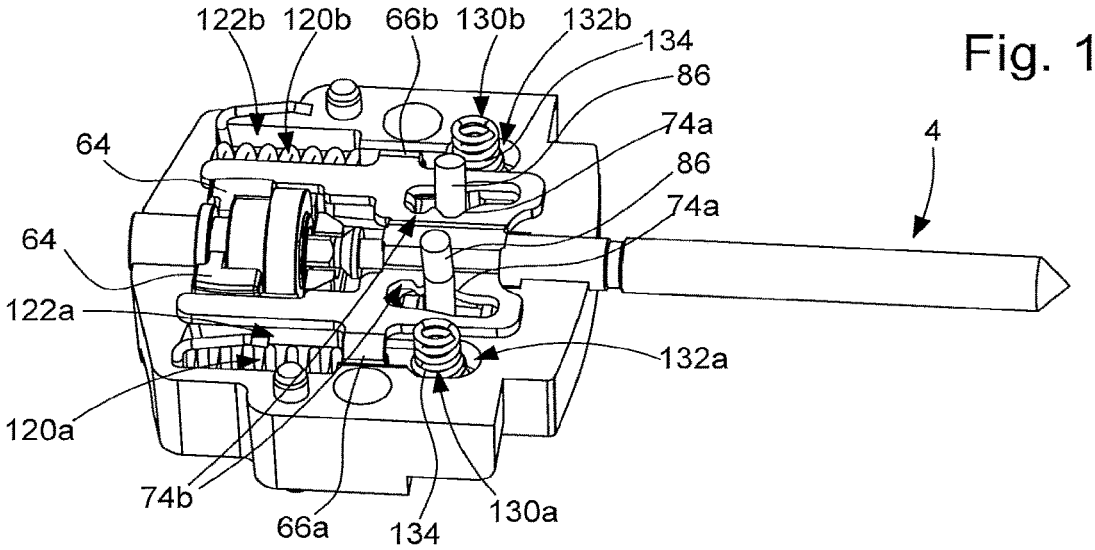
FIG. 12A is a perspective view showing the control stem cooperating with the position indexing plate and the positioning spring, the control stem being in stable position T1.
Figure 12B:
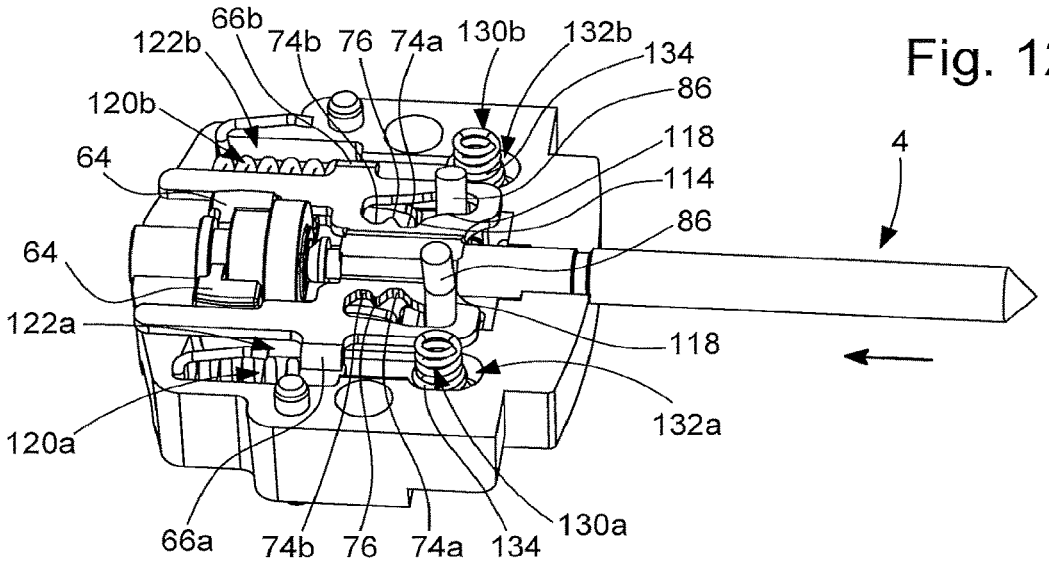
FIG. 12B is a similar view to that of FIG. 12A, with the control stem in an unstable pushed-in position T0.
Figure 12C:
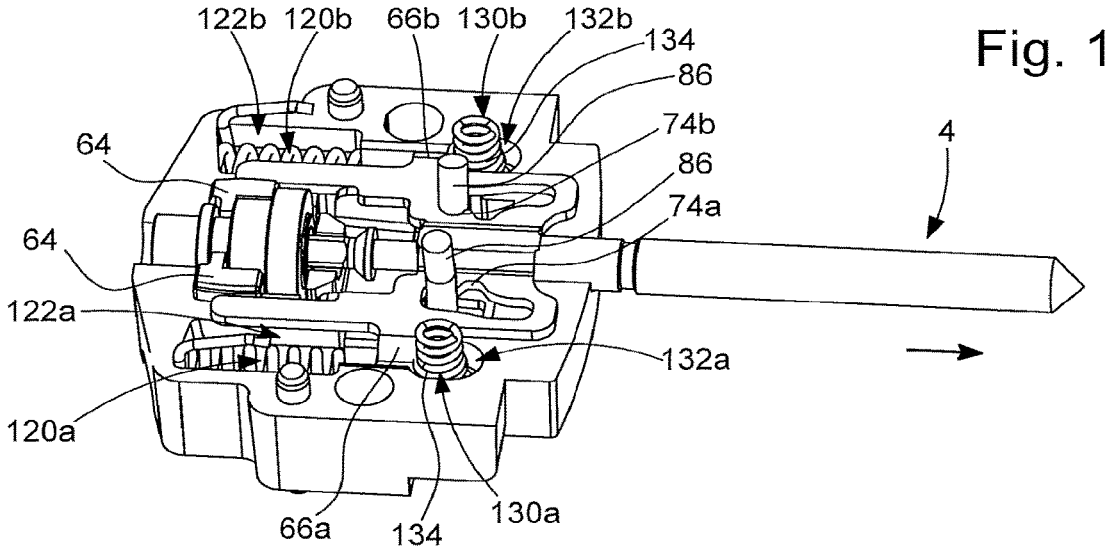
FIG. 12C is a similar view to that of FIG. 12A, with the control stem in stable pulled-out position T2.

From its stable rest position T1, control stem 4 can be pushed forwards into an unstable position T0 or pulled out into a stable position T2. These three positions T0, T1 and T2 of control stem 4 are indexed by cooperation between position indexing plate 58 and positioning spring 80. More precisely (see FIG. 12A), the stable rest position T1 corresponds to the position in which ends 78 of arms 86 of positioning spring 80 project into first recesses 74*a* of the two apertures 70 provided in guide arms 62 of position indexing plate 58. From this stable rest position T1, control stem 4 can be pushed forwards into an unstable position T0 (see FIG. 12B). During this displacement, ends 78 of arms 86 of positioning spring 80 leave first recesses 74*a* and follow a first ramp profile 114 which gradually moves away from longitudinal axis of symmetry X-X of control stem 4 along a first steep slope α (see FIG. 7B). To force ends 78 of arms 86 of positioning spring 80 to leave first recesses 74*a* and to engage on first ramp profile 114 by moving away from each other, the user must therefore overcome a significant resistance force.

When they reach a transition point 116, ends 78 of arms 86 engage on a second ramp profile 118 which extends first ramp profile 114 with a second slope β lower than first slope α of first ramp profile 114. At the instant that ends 78 of arms 86 of positioning spring 80 cross transition point 116 and engage on second ramp profile 118, the force required from the user to continue moving control stem 4 drops sharply and the user feels a click indicating the transition of control stem 4 between position T1 and position T0. As they follow second ramp profile 118, arms 86 of positioning spring 80 continue to move slightly away from their rest position and tend to try to move towards each other again under the effect of their elastic return force opposing the thrust force exerted by the user on control stem 4. As soon as the user releases pressure on control stem 4, arms 86 of positioning spring 80 will spontaneously return down first ramp profile 114 and their ends 78 will lodge again inside first recesses 74*a* of the two apertures 70 provided in guide arms 62 of position indexing plate 58. Control stem 4 is thus automatically returned from its unstable position T0 to its first stable position T1.

First and second contact springs 120*a* and 120*b* are arranged compressed inside a first and a second cavity 122*a* and 122*b* provided in lower frame 2. These first and second contact springs 120*a* and 120*b* could be helical contact springs, strip-springs or other springs. The two cavities 122*a*, 122*b* preferably, but not necessarily, extend horizontally. Because the two contact springs 120*a*, 120*b* are installed in the compressed state, their positioning precision is dependent on the manufacturing tolerance of lower frame 2. The manufacturing precision of lower frame 2 is higher than the manufacturing precision of these two first and second contact springs 120*a*, 120*b*. Consequently, the precision of detection of position T0 of control stem 4 is high.

Figure 13:
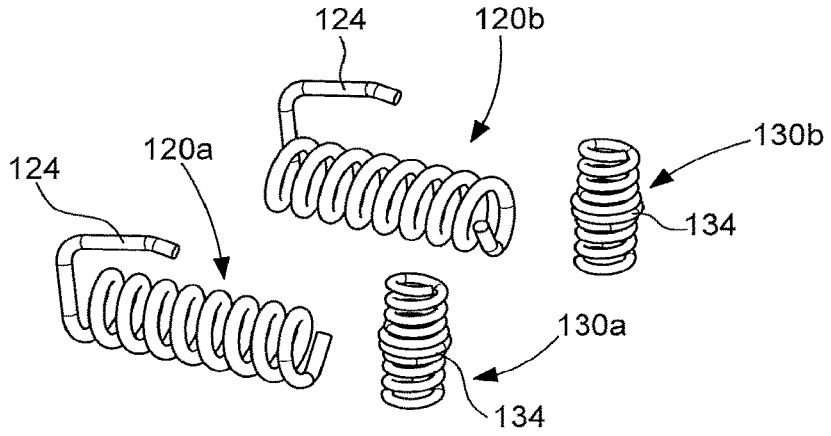
FIG. 13 is a perspective view of the first and second contact springs.
Figure 15:
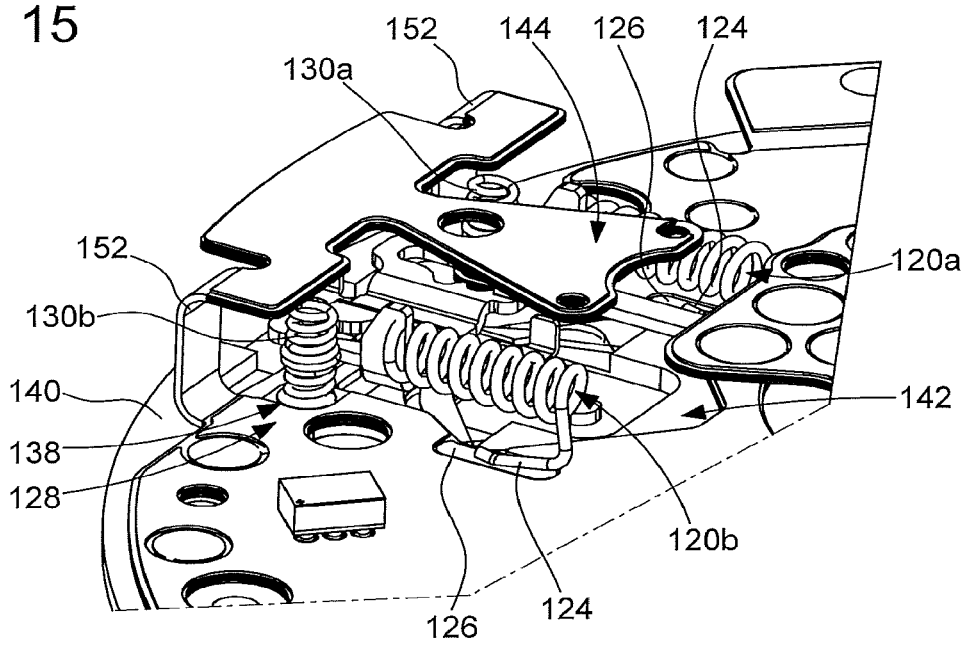
FIG. 15 is a partial, perspective view of the flexible printed circuit sheet on which are arranged the contact pads of the first and second contact springs.

As visible in FIGS. 13 and 15, one of the ends of first and second contact springs 120*a*, 120*b* is bent to form two contact lugs 124 which will move into abutment on two corresponding first contact pads 126 provided at the surface of a flexible printed circuit sheet 128. The moment that ends 78 of arms 86 of positioning spring 80 engage on second ramp profile 118 of the two apertures 70 provided in position indexing plate 58 coincides with the moment that fingers 66*a*, 66*b* of position indexing plate 58 come into contact with first and second contact springs 120*a*, 120*b*. Since this position indexing plate 58 is electrically conductive, when fingers 66*a*, 66*b* come into contact with first and second contact springs 120*a*, 120*b*, the electric current passes through position indexing plate 58 and closure of the electrical contact between first and second contact springs 120*a*, 120*b* is detected.

First and second contact springs 120*a*, 120*b* are of the same length. However, preferably, one of the first and second cavities 122*a*, 122*b* will be longer than the other, in particular to take account of tolerance problems (the difference in length between the two cavities 122*a*, 122*b* is several tenths of a millimetre). Thus, when control stem 4 is pushed forwards into position T0, finger 66*a* of position indexing plate 58, which is lined up with first contact spring 120*a* housed inside the first, longest cavity 122*a*, will come into contact with and start to compress first contact spring 120*a*. Control stem 4 will continue to move forward and second finger 66*b* of position indexing plate 58 will come into contact with second contact spring 120*b* housed inside the second, shortest cavity 122*b*. At that moment, position indexing plate 58 will be in contact with first and second contact springs 120*a*, 120*b* and the electric current will flow through position indexing plate 58, which allows the closure of the electrical contact between the first two contact springs 120*a*, 120*b* to be detected. It is noted that fingers 66*a*, 66*b* of position indexing plate 58 move into abutment contact with first and second contact springs 120*a*, 120*b*. There is thus no friction or wear when control stem 4 is pushed forwards into position T0 and closes the circuit between first and second contact springs 120*a*, 120*b*. It is also noted that, the difference in length of first and second cavities 122*a* and 122*b* ensures that closure of the electrical contact and entry of the corresponding command into the portable object equipped with control device 1 occur only after a click is felt.

When the two fingers 66*a*, 66*b* of position indexing plate 58 are in contact with first and second contact springs 120*a*, 120*b*, first contact spring 120*a* housed inside first, longest cavity 122*a* is in a compressed state. Consequently, when the user releases pressure on control stem 4, this first contact spring 120*a* relaxes and forces control stem 4 to return from its unstable pushed-in position T0 to its first stable position T1. The first and second contact springs 120*a*, 120*b* thus act simultaneously as electrical contact parts and elastic return means for control stem 4 in its first stable position T1.

From first stable position T1, it is possible to pull control stem 4 backwards into a second stable position T2 (see FIG.

12C). During this movement, ends 78 of arms 86 of positioning spring 80 will elastically deform to pass from first recesses 74*a* to second recesses 74*b*, crossing peaks 76 of the two apertures 70 provided in guide arms 62 of position indexing plate 58. When control stem 4 reaches its second stable position T2, the two fingers 66*a*, 66*b* of position indexing plate 58 move into abutment against third and fourth contact springs 130*a* 130*b* (see FIG. 13), which are housed inside third and fourth cavities 132*a*, 132*b* provided in lower frame 2. These third and fourth contact springs 130*a*, 130*b* could be helical contact springs, strip-springs or other springs. Third and fourth cavities 132*a*, 132*b* preferably extend vertically for reasons of space in control device 1. Since position indexing plate 58 is electrically conductive, when fingers 66*a*, 66*b* come into contact with third and fourth contact springs 130*a*, 130*b*, the electric current flows through position indexing plate 58 and closure of electrical contact T2 between these contact springs 130*a*, 130*b* is detected.

It will be noted that, in the case of stable position T2, fingers 66*a*, 66*b* of position indexing plate 58 also come into abutment contact with third and fourth contact springs 130*a*, 130*b*, thereby avoiding any risk of wear from friction. Further, third and fourth contact springs 130*a*, 130*b* are capable of bending when fingers 66*a*, 66*b* of position indexing plate 58 collide therewith, and therefore of absorbing any lack of precision in the positioning of position indexing plate 58.

Figure 14A:
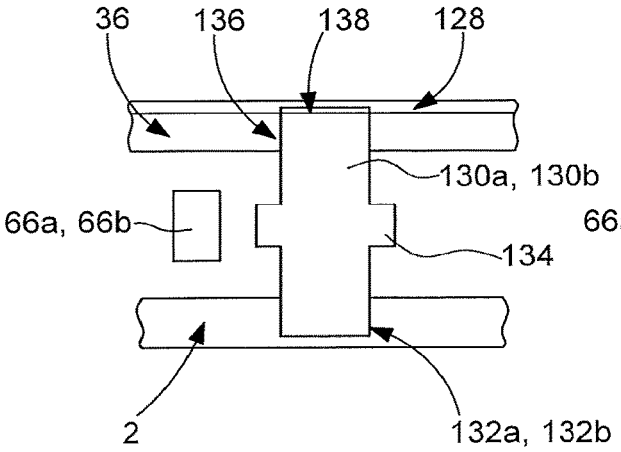
FIGS. 14A and 14B are schematic views that illustrate the cooperation between the fingers of the control stem position indexing plate and third and fourth contact springs.
Figure 14B:
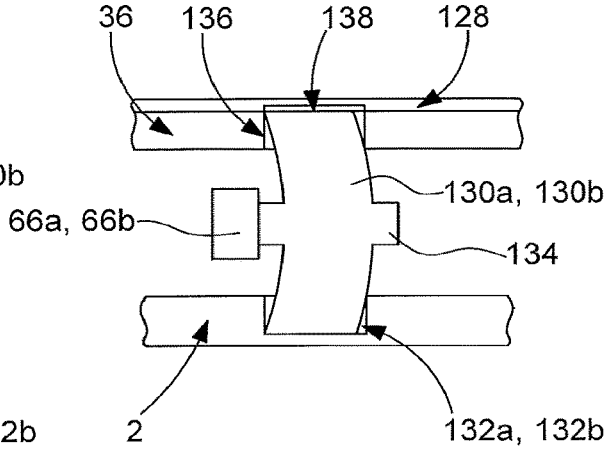

Preferably, but not necessarily, third and fourth contact springs 130*a*, 130*b* are arranged to work in flexion. Indeed, with contact springs 130*a*, 130*b* whose diameter is constant, fingers 66*a*, 66*b* of position indexing plate 58 come into contact with contact springs 130*a*, 130*b* over a large surface close to their points of attachment in lower frame 2 and upper frame 36. The proximity of the contact surface to the attachment points of contact springs 130*a*, 130*b* induces shearing stresses in contact springs 130*a*, 130*b* which may lead to premature wear and breakage of the latter. To overcome this problem, contact springs 130*a*, 130*b* have, preferably substantially at mid-height, an increase in diameter 134 which comes into contact with fingers 66*a*, 66*b* of position indexing plate 58 when control stem 4 is pulled into its stable position T2 (see FIGS. 14A and 14B). At their upper end, third and fourth contact springs 130*a*, 130*b* are guided in two holes 136 provided in upper frame 36 and come into contact with second contact pads 138 provided at the surface of flexible printed circuit sheet 128. It is clear that, when control stem 4 is pulled backwards into its stable position T2, fingers 66*a*, 66*b* of positioning indexing plate 58 come into contact on a reduced surface with third and fourth contact springs 130*a* and 130*b* at their largest diameter 134, which allows contact springs 130*a*, 130*b* to bend between their two points of attachment in lower frame 2 and upper frame 36.

Figure 16:
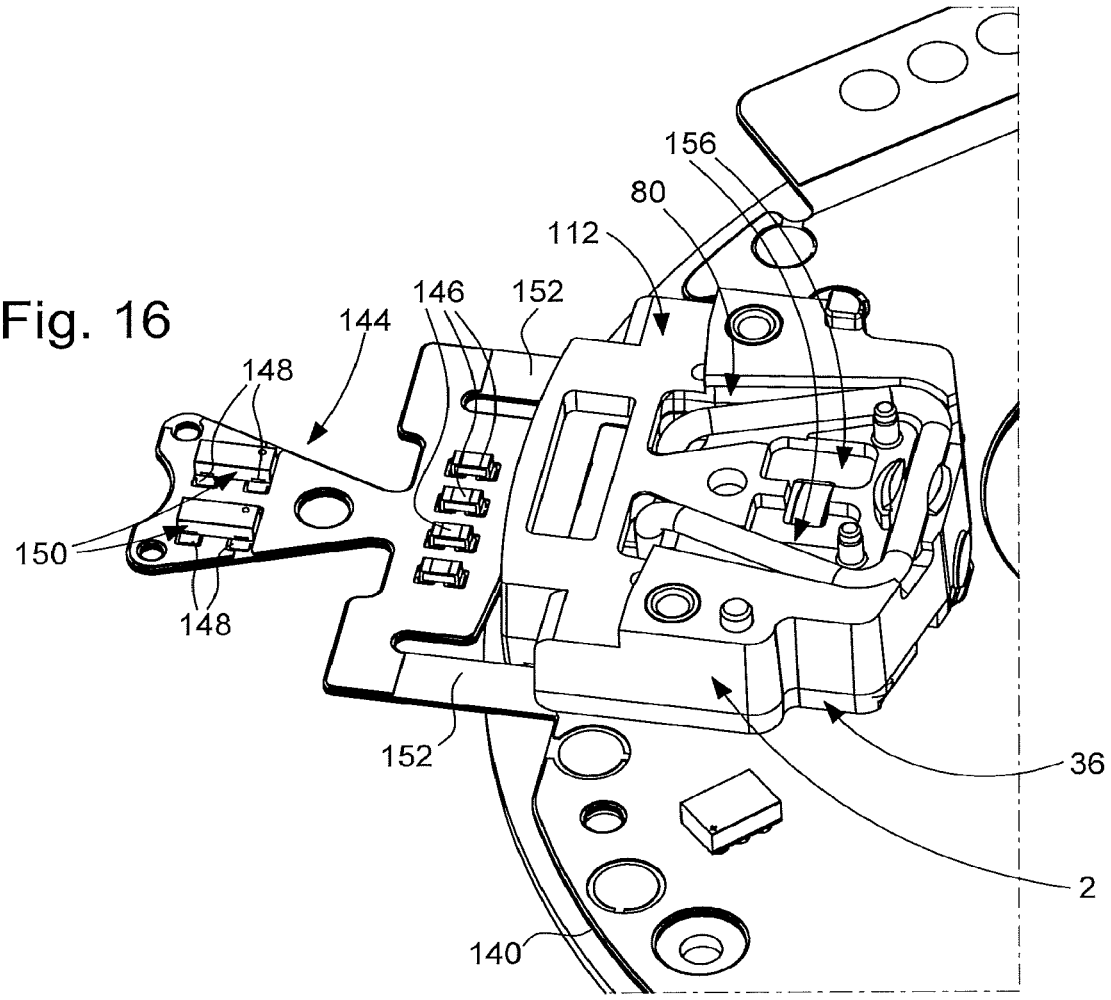
FIG. 16 is a perspective view of the free portion of the flexible printed circuit sheet on which are fixed the inductive sensors.

In FIG. 15, lower and upper frames 2 and 36 have been deliberately omitted to facilitate understanding of the drawing. As represented in FIG. 15, flexible printed circuit sheet 128 is fixed on a plate 140 located on the dial side of the portable object. It includes, in particular, of a cutout 142 adapted in shape and size to receive upper frame 36. One portion 144 of flexible printed circuit sheet 128 remains free (see FIG. 16). This free portion 144 of flexible printed circuit sheet 128 carries a plurality of electronic components 146, in addition to third contact pads 148, on which are fixed at least two inductive sensors 150. An 'inductive sensor' means a sensor that transforms a magnetic field passing therethrough into electric voltage due to the phenomenon of induction defined by Lenz's law and Faraday's law. By way of example, this may be a Hall effect sensor or a magnetoresistance component of the AMR (anisotropic magnetoresistance), GMR (giant magnetoresistance) or TMR (tunneling magnetoresistance) type.

Figure 17A:
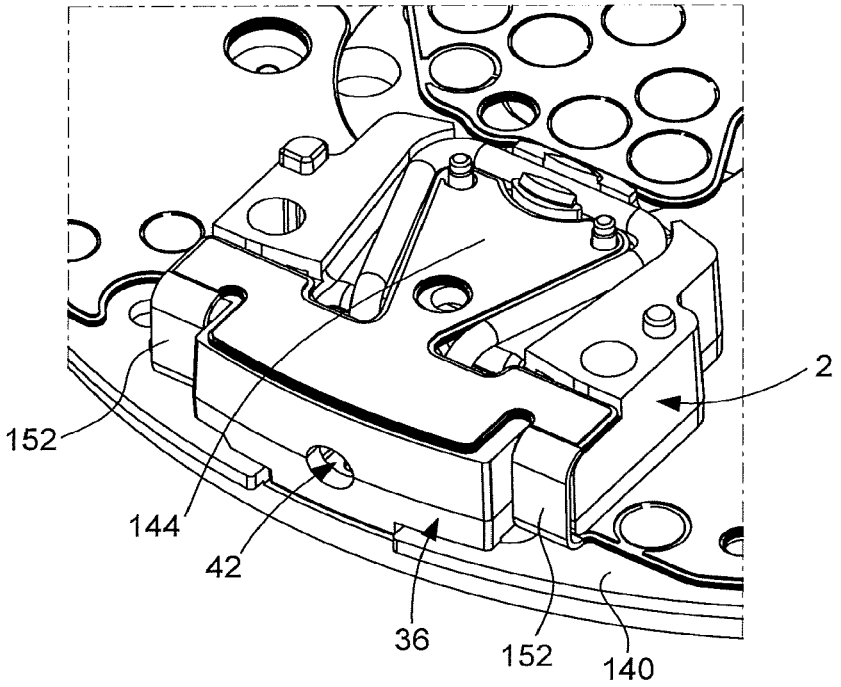
FIG. 17A is a perspective view of the control device, onto a rear face of which is folded the free portion of the flexible printed sheet.
Figure 17B:
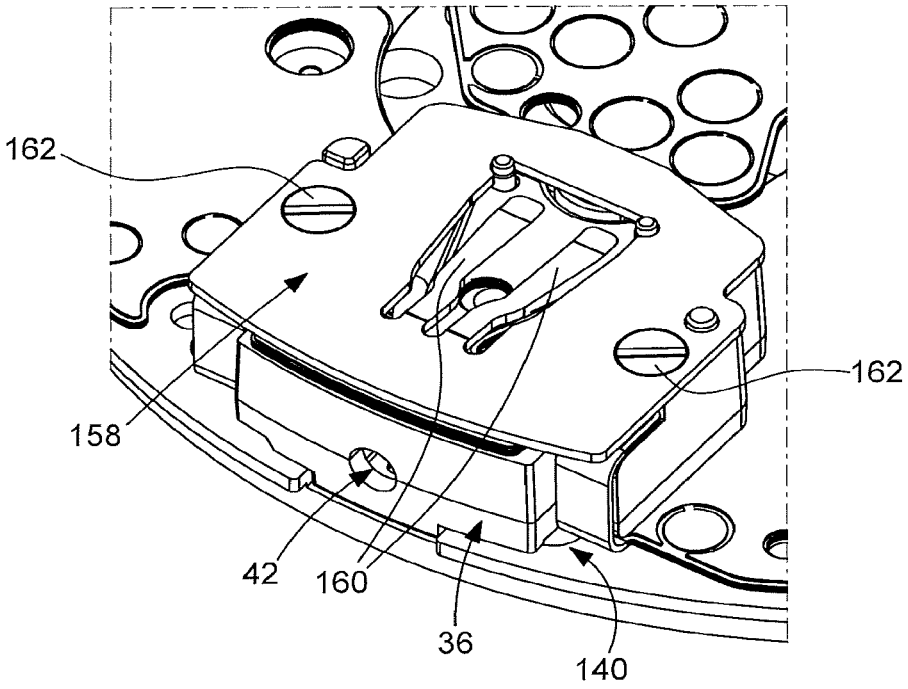
FIG. 17B is a perspective view of the control device, onto a rear face of which the free portion of the flexible printed circuit sheet is folded and held by means of a holding plate fixed by screws to the control device.

The free portion 144 of flexible printed circuit sheet 128 is connected to the rest of flexible printed circuit sheet 128 by two strips 152, which allow free portion 144 to be folded around the assembly of upper frame 36 and lower frame 2, and then folded down against a lower surface 112 of lower frame 2, so that inductive sensors 150 penetrate two housings 156 provided in lower surface 112 of lower frame 2. Thus positioned inside their housings 156, inductive sensors 150 are precisely located under magnetized ring 18, which ensures reliable detection of the direction of rotation of control stem 4. Once free portion 144 of flexible printed circuit sheet 128 has been folded down against lower frame 2 (see FIG. 17A), the assembly is covered by a holding plate 158, provided with one or two elastic fingers 160, which press inductive sensors 150 against the bottom of their housings 156 (see FIG. 17B). Holding plate 158 is fixed to plate 140, for example by means of two screws 162.

It goes without saying that the present invention is not limited to the embodiment that has just been described and that various simple modifications and variants can be envisaged by those skilled in the art without departing from the scope of the invention as defined by the annexed claims. In particular, the dimensions of the magnetized ring may be extended so that it corresponds to a hollow cylinder. It will be understood, in particular, that position indexing plate 58 may define only two distinct positions, namely two stable positions or one stable position and one unstable position, or it may define three or more distinct positions, namely at least three stable positions or at least two stable positions and one unstable position.

Figure 20A:
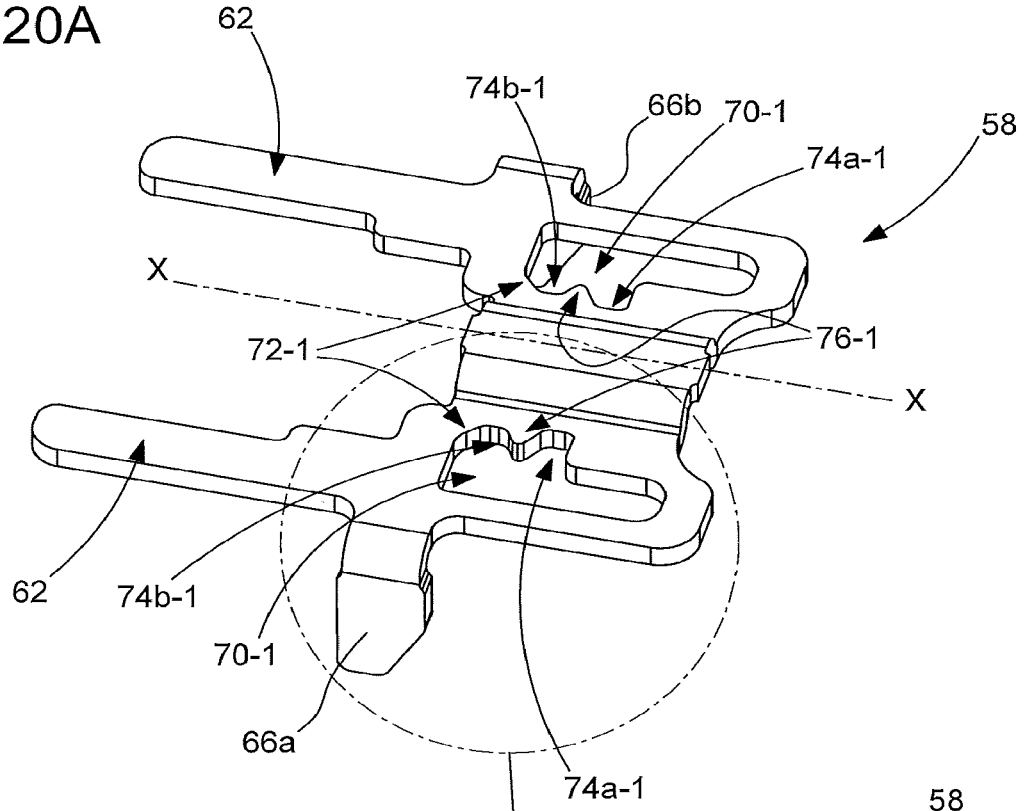
FIG. 20A is a top, perspective view of the plate for indexing the position of the control stem which defines only two stable positions.
Figure 20B:
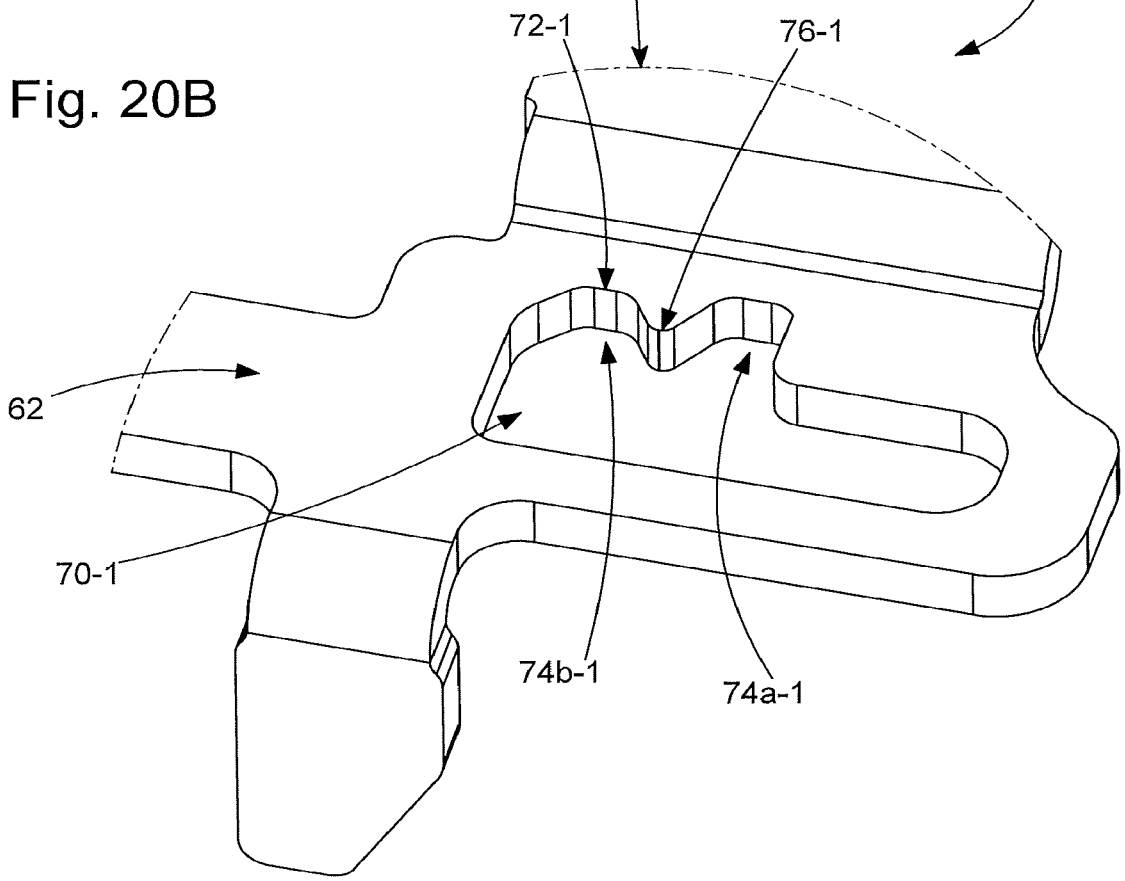
FIG. 20B is a larger scale view of the area encircled in FIG. 20A.

FIG. 20A illustrates the case where position indexing plate 58 defines only two stable positions. In such case, two apertures 70-1 exhibiting an approximately rectangular contour are provided in guide arms 62 of position indexing plate 58. These two apertures 70-1 extend symmetrically on either side of longitudinal axis of symmetry X-X of control stem 4. The sides of the two apertures 70-1 closest to longitudinal axis of symmetry X-X of control stem 4 have a cam path 72-1 of substantially sinusoidal shape, formed of a first and a second recess 74*a*-1, 74*b*-1 separated by a peak 76-1. The two apertures 70-1 provided in guide arms 62 are intended to receive the two ends 78 of the arms of positioning spring 80 in order to index the position of control stem 4 between a first and a second stable position T1-1 and T2-1.

More precisely, the first stable position T1-1 corresponds to the position in which ends 78 of arms 86 of positioning spring 80 project into first recesses 74*a*-1 of the two apertures 70-1 provided in guide arms 62 of position indexing plate 58. From this first stable position T1-1, control stem 4 can be pulled back into a second stable position T2-1. During this movement, ends 78 of arms 86 of positioning spring 80 will elastically deform to pass from first recesses 74*a*-1 to second recesses 74*b*-1, crossing peaks 76-1 of the two apertures 70-1 provided in guide arms 62 of position indexing plate 58.

Figure 21A:
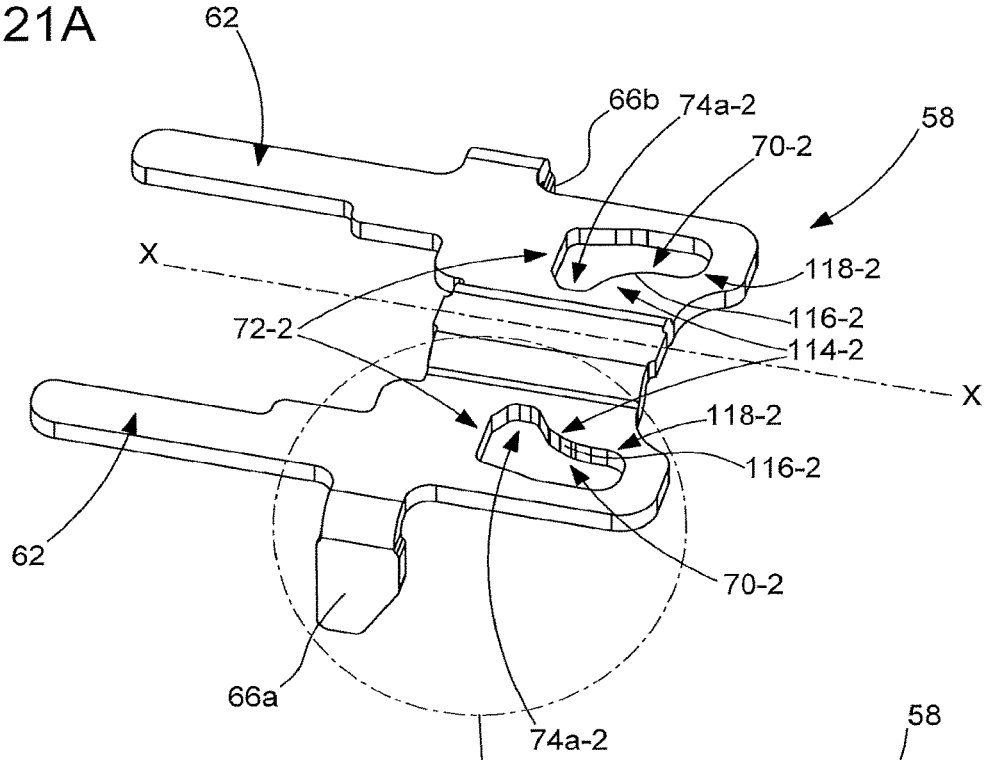
FIG. 21A is a top, perspective view of the plate for indexing the position of the control stem which defines only one stable position and one unstable pushed-in position.
Figure 21B:
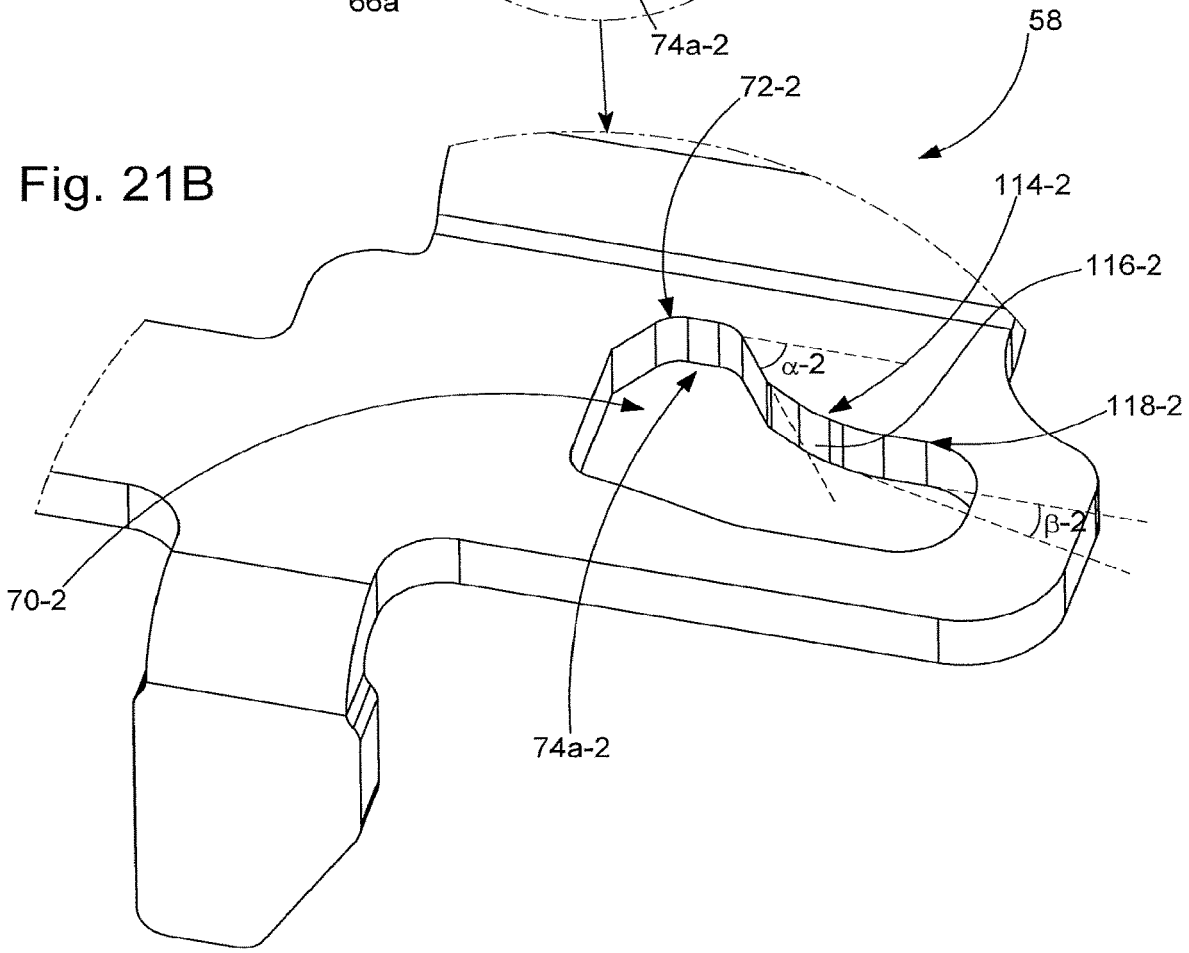
FIG. 21B is a larger scale view of the area encircled in FIG. 21A.
Figure 22:
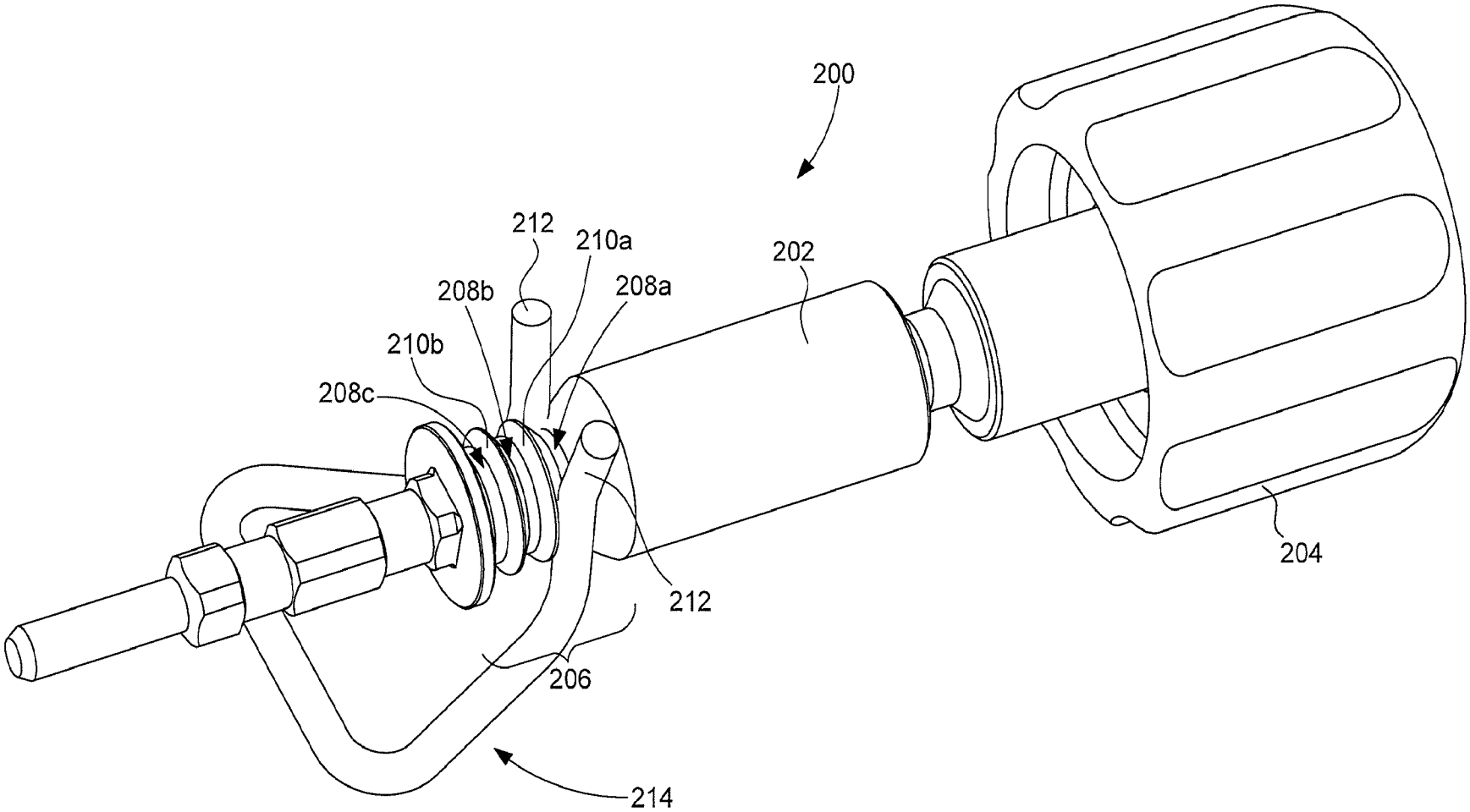
FIG. 22, already cited, is a perspective view of a control stem according to the prior art.

FIG. 21A illustrates the case where indexing plate 58 defines only one stable position T1-2 and one unstable position T0-2. In such case, two apertures 70-2 exhibiting an approximately rectangular contour are provided in guide arms 62 of position indexing plate 58. These two apertures 70-2 extend symmetrically on either side of longitudinal axis of symmetry X-X of control stem 4. The sides of the two apertures 70-2 closest to longitudinal axis of symmetry X-X of control stem 4 have a cam path 72-2 formed of a recess 74*a*-2 followed by a ramp profile 114-2 which gradually moves away from longitudinal axis of symmetry X-X of control stem 4 on a first steep slope α-2. To force ends 78 of arms 86 of positioning spring 80 to leave recesses 74*a*-2 and to engage on first ramp profile 114-2 by moving away from each other, the user must therefore overcome a significant resistance force. When they reach a transition point 116-2, ends 78 of arms 86 engage on a second ramp profile 118-2 which extends first ramp profile 114-2 with a second slope β-2 lower than first slope α-2 of first ramp profile 114-2. At the instant that ends 78 of arms 86 of positioning spring 80 cross transition point 116-2 and engage on second ramp profile 118-2, the force required from the user to continue moving control stem 4 drops sharply and the user feels a click indicating the transition of control stem 4 between its stable position T1-2 and its unstable position T0-2. As they follow second ramp profile 118-2, arms 86 of positioning spring 80 continue to move slightly away from their rest position and tend to try to move towards each other again under the effect of their elastic return force opposing the thrust force exerted by the user on control stem 4. As soon as the user releases pressure on control stem 4, arms 86 of positioning spring 80 will spontaneously move back down first ramp profile 114-2 and lodge again inside recesses 74*a*-2 of the two apertures 70-2 provided in guide arms 62 of position indexing plate 58. Control stem 4 is thus automatically returned from its unstable position T0-2 to its stable position T1-2.

NOMENCLATURE

1. Control device
2. Lower frame
4. Control stem
X-X. Longitudinal axis of symmetry
6. Rear end
8. Actuation crown
10. Front end
12. Square section
14. Magnetic assembly
16. Smooth bearing
18. Magnetized ring
20. Support ring
22*a*. First section
D1. First external diameter
22*b*. Second section
D2. Second external diameter
24. Shoulder
26. Square hole
28. Cylindrical housing
D3. First internal diameter
30. Annular hole
D4. Second internal diameter
D5. Third external diameter
32. Circular collar
34*a* First groove
34*b*. Second groove
36. Upper frame
38. First receiving surface
40. Second receiving surface
42. Hole
44*a*, 46*a* Third and fourth undercut surfaces
44*b*, 46*b* Complementary undercut surfaces
48. Case middle
49. Bottom
50. Annular collar
52. Cylindrical section
54. Back section
56. Groove
58. Position indexing plate
60. Curved portion
62. Guide arm
64. Studs
66*a*, 66*b* Fingers
68. Rim
70. Apertures
72. Cam path
74*a* First recess
74*b*. Second recess
76. Peak
78. Ends
80. Positioning spring
82. Arbors
84. Base
86. Arms
88. Displacement limiting spring
90. Central portion
92. Pair of elastic arms
94. Pair of elastic arms
96. Stiff lugs
98. Disassembly plate
100. Straight segment
102. First crosspiece
104. Second crosspiece
106. Lugs
108. Housing
110. Hole
112. Lower face
114. First ramp profile
α First slope
116. Transition point
118. Second ramp profile
β Second slope
120*a*, 120*b* First and second contact spring
122*a*, 122*b* First and second cavity
124. Contact lugs
126. First contact pads
128. Flexible printed circuit sheet
130*a*, 130*b* Third and fourth contact springs
132*a*, 132*b* Third and fourth cavities
134. Increase in diameter
136. Holes
138. Second contact pads
140. Plate
142. Cutout
144. Free portion
146. Electronic components
148. Third contact pads
150. Inductive sensors
152. Strips
156. Cavities
158. Holding plate
160. Elastic fingers
162. Screw
70-1. Apertures
72-1. Cam path
74*a*-1. First recess
74*b*-1. Second recess
70-2. Apertures
72-2. Cam path
74*a*-2. Recess

114-2. First ramp profile
α-2. First slope
116-2. Transition point
118-2. Second ramp profile
β-2. Second slope
200. Control stem
202. Cylindrical portion
204. Actuation crown
206. Cam paths
208*a*, 208*b* Recess
210. Peak
212. Elastic arms
214. Spring

What is claimed is:

1. A device for controlling at least two electronic and/or mechanical functions of a portable object of small dimensions, the device comprising:

a control stem which is axially movable between at least a first position and a second position, wherein the control stem is provided at a first end with an actuation member; and a position indexing plate engaged with the control stem to ensure the coupling in translation, from front to back and from back to front, between control stem and the position indexing plate, the position indexing plate being provided with at least one cam path arranged to cooperate with an elastic member in order to match each of the first and second positions of the control stem with one of the mechanical or electronic functions.

2. The device according to claim 1, wherein the indexing plate extends substantially in a horizontal plane.

3. The device according to claim 1, wherein the position indexing plate comprises two identical cam paths, including a first cam path in a first aperture in the position indexing plate and a second cam path in a second aperture in the position indexing plate, and wherein the elastic member includes a first arm that extends through the first aperture to cooperate with the first cam path and a second arm that extends through the second aperture to cooperate with the second cam path to define the first and second position of control stem.

4. The device according to claim 3, wherein the two cam paths define one unstable position and one stable position of the control stem.

5. The device according to claim 4, wherein the two cam paths each comprise a recess which defines the stable position of the control stem, wherein the arms of the elastic member leave the recesses to engage on a ramp profile which moves the arms away from the rest position thereof and which defines the unstable position of the control stem.

6. The device according to claim 5, wherein the cam paths comprise a first ramp profile which diverges on a first slope and which is extended by a second ramp profile which diverges on a second slope lower than the first slope of the first ramp profile.

7. The device according to claim 3, wherein the two cam paths define a first and a second stable position of the control stem.

8. The device according to claim 7, wherein the two cam paths comprise a first recess separated from a second recess by a peak, wherein the first recess and the second recess define the first stable position and the second stable position of the control stem, wherein the arms of the elastic member move from the first recess to the second recess and vice versa by crossing the peak.

9. The device according to claim 3, wherein the indexing plate includes two guide arms that extend parallel to one another and are connected to each other by a curved portion, and a first of the two guide arms includes the first aperture and a second of the two guide arms includes the second aperture.

10. The device according to claim 9, wherein the indexing plate includes two fingers and each of the fingers extend vertically downward from a respective one of the two guide arms.

11. The device according to claim 3, wherein the first aperture and the second aperture extend symmetrically on opposite sides of a longitudinal axis of the control stem.

12. The device according to claim 1, wherein the position indexing plate comprises two identical cam paths, including a first cam path in a first aperture in the position indexing plate and a second cam path in a second aperture in the position indexing plate, and wherein the elastic member includes a first arm that extends through the first aperture to cooperate with the first cam path and a second arm that extends through the second aperture to cooperate with the second cam path to define the first and second position of control stem.

13. The device according to claim 12, wherein the two cam paths define one unstable position and one stable position of the control stem.

14. The device according to claim 13, wherein the two cam paths each comprise a recess which defines the stable position of the control stem, wherein the arms of the elastic member leave the recesses to engage on a ramp profile which moves the aims away from the rest position thereof and which defines the unstable position of the control stem.

15. The device according to claim 14, wherein the cam paths comprise a first ramp profile which diverges on a first slope and which is extended by a second ramp profile which diverges on a second slope lower than the first slope of the first ramp profile.

16. The device according to claim 12, wherein the two cam paths define a first and a second stable position of the control stem.

17. The device according to claim 16, wherein the two cam paths comprise a first recess separated from a second recess by a peak, wherein the first recess and the second recess define the first stable position and the second stable position of the control stem, wherein the arms of the elastic member move from the first recess to the second recess and vice versa by crossing the peak.

18. The device according to claim 1, wherein the position indexing plate is housed inside a groove provided in the control stem.

19. The device according to claim 18, wherein the position indexing plate is integral with the control stem.

20. The device according to claim 19, wherein the position indexing plate is removably coupled to the control stem.

21. The device according to claim 20, wherein the coupling between the position indexing plate and the control stem is an elastic coupling arranged to prevent the uncoupling of the position indexing plate and the control stem in normal conditions of use.

22. The device according to claim 21, wherein a spring for limiting the displacement of the position indexing plate in a vertical direction is placed above and at a distance from the position indexing plate such that the displacement limiting spring is not, in normal conditions of use, in contact with the position indexing plate, but is, however, sufficiently close to the position indexing plate to prevent the latter being inadvertently uncoupled from the control stem.

* * * * *